US007618140B2

(12) United States Patent
Kato

(10) Patent No.: US 7,618,140 B2
(45) Date of Patent: Nov. 17, 2009

(54) IMAGE RECORDING DEVICE

(75) Inventor: Shinya Kato, Nagoya (JP)

(73) Assignee: Brother Kogyo Kabushiki, Nagoya-shi, Aichi-ken (JP)

( * ) Notice: Subject to any disclaimer, the term of this patent is extended or adjusted under 35 U.S.C. 154(b) by 316 days.

(21) Appl. No.: 11/277,636

(22) Filed: Mar. 28, 2006

(65) Prior Publication Data

US 2006/0221165 A1 Oct. 5, 2006

(30) Foreign Application Priority Data

Mar. 29, 2005 (JP) ..... 2005-095792

(51) Int. Cl.
*B41J 2/01* (2006.01)

(52) U.S. Cl. ..... 347/104; 271/10.1; 271/227; 271/259; 347/14; 347/19; 358/1.9; 358/437; 358/488; 358/498; 400/624; 400/706

(58) Field of Classification Search ..... None
See application file for complete search history.

(56) References Cited

U.S. PATENT DOCUMENTS 5,280,899 A * 1/1994 Kida et al. ..... 271/10.1
5,365,322 A * 11/1994 Hamada et al. ..... 399/21
5,738,457 A * 4/1998 Ishida et al. ..... 400/706
5,923,441 A * 7/1999 Komada et al. ..... 358/437
5,983,049 A 11/1999 Matsuya et al.
6,126,345 A * 10/2000 Ito et al. ..... 400/624
6,137,600 A * 10/2000 Sakurai et al. ..... 358/498
6,301,022 B1 * 10/2001 Washio et al. ..... 358/488
6,508,465 B1 1/2003 Endo
6,651,980 B2 * 11/2003 Isemura et al. ..... 271/259

(Continued)

FOREIGN PATENT DOCUMENTS

JP H01-233958 A 9/1989

(Continued)

OTHER PUBLICATIONS

Japan Patent Office; Notice of Reasons for Rejection in Japanese Patent Application No. 2005-095792 (counterpart to the above-captioned U.S. patent application) mailed Apr. 14, 2009.

*Primary Examiner*—Matthew Luu
*Assistant Examiner*—John P Zimmermann
(74) *Attorney, Agent, or Firm*—Baker Botts, LLP

(57) ABSTRACT

An image recording device includes a conveying mechanism disposed in a predetermined conveying path including a plurality of rollers for conveying a recording medium by a predetermined conveying distance while nipping the recording medium. The device also includes an upstream-side trailing edge detector for detecting a trailing edge of the recording medium, a downstream-side trailing edge detector for detecting the trailing edge of the recording medium, and a skip warning region determination unit for determining whether the trailing edge is located in a skip warning region. Moreover, the device includes a storage unit for storing a correction value table including a predetermined correction value, and a correction unit for correcting the predetermined conveying distance when the trailing edge is in the skip warning region. The device also includes a skipping distance calculation unit for calculating the skipping distance observed on the recording medium, and for adjusting the predetermined correction value in the correction value table based on the calculated skipping distance.

18 Claims, 24 Drawing Sheets

U.S. PATENT DOCUMENTS

| | | | | |
|---|---|---|---|---|
| 6,733,101 | B2 * | 5/2004 | Katayama et al. | 347/14 |
| 6,834,853 | B2 * | 12/2004 | Trovinger et al. | 271/227 |
| 6,851,802 | B2 | 2/2005 | Sakakibara et al. | |
| 6,869,241 | B2 | 3/2005 | Ouchi et al. | |
| 7,117,795 | B2 * | 10/2006 | Schultze et al. | 101/485 |
| 7,474,437 | B2 * | 1/2009 | Ishido | 358/1.9 |
| 2002/0191064 | A1 * | 12/2002 | Ishikawa et al. | 347/104 |
| 2003/0142279 | A1 * | 7/2003 | Oono | 355/40 |
| 2005/0024464 | A1 * | 2/2005 | Takagi | 347/104 |
| 2005/0154562 | A1 * | 7/2005 | Matsuura et al. | 702/185 |
| 2006/0055721 | A1 * | 3/2006 | Burdette et al. | 347/19 |
| 2006/0203028 | A1 * | 9/2006 | Agarwal et al. | 347/19 |

FOREIGN PATENT DOCUMENTS

| | | | |
|---|---|---|---|
| JP | H02-184474 | A | 7/1990 |
| JP | 9240088 | A | 9/1997 |
| JP | H10-039556 | A | 2/1998 |
| JP | H10-139191 | A | 5/1998 |
| JP | H10-198093 | A | 7/1998 |
| JP | H10-338379 | A | 12/1998 |
| JP | 2002361958 | A | 12/2002 |
| JP | 2004-025856 | A1 | 1/2004 |
| JP | 2004-059192 | A | 2/2004 |
| JP | 2004-090316 | A | 3/2004 |
| JP | 2004-330583 | A | 11/2004 |

* cited by examiner

Fig. 10

CORRECTION VALUE TABLE T

| PAPER TYPE t | SIZE s | | | | | |
|---|---|---|---|---|---|---|
| | L | 2L | A5 | B5 | A4 |
| PLAIN PAPER | 0 | 0 | 0 | 0 | 0 |
| CARDBOARD | a1 | a2 | a3 | a4 | a5 |
| GLOSSY PAPER | a6 | a7 | a8 | a9 | a10 |

IMAGE RECORDING DEVICE

CROSS REFERENCE TO RELATED APPLICATION

The present application claims priority from Japanese Patent Application No. 2005-095792, filed on Mar. 29, 2005, the disclosure of which is incorporated herein by reference in its entirety.

BACKGROUND OF THE INVENTION

1. Field of the Invention

The present invention relates generally to image recording device, and in particular, the present invention is directed towards image recording device in which images are recorded to a recording medium while the recording medium is nipped and conveyed by a pair of rollers disposed in a conveying path.

2. Description of Related Art

Referring to FIGS. 22 and 23, in a known image recording device, recording paper P is conveyed on to a platen 93 while the recording paper P is nipped between a conveying roller 94 and the pressure roller 95 on the upstream side. When the tip edge of the recording paper P is disposed below a recording head 91, a scanning carriage 92 begins scanning, such that the recording head 91 discharges ink on to the recording paper P. The conveying roller 94 and the pressure roller 95 intermittently are driven based on a predetermined line feed pitch. Each time that the conveying roller 94 and the pressure roller 95 intermittently are driven, the scanning carriage 92 performs scanning, such that the recording head 91 performs image recording. By repeating such an operation, image recording is applied to a predetermined portion of the recording paper P, which is conveyed on the basis of the predetermined line feed pitch. When the tip edge of the recording paper P reaches the conveying roller 94 and the pressure roller 95 on the downstream side, images are recorded on the recording paper P while the recording paper P is nipped by the conveying roller 94 and the pressure roller 95 at the tip edge side and the trailing edge side thereof As the recording paper P moves, the trailing edge of the recording paper P passes through the conveying roller 94 and the pressure rollers 95 on the upstream side, and the recording paper P is conveyed by the conveying roller 94 and the pressure roller 95 on the downstream side. After imaging is complete, the recording paper P is ejected after passing through the conveying roller 94 and the pressure rollers 95.

The conveying roller 94 and the pressure roller 95 abut each other on their roller surfaces, such that a nip region is formed therebetween. When the trailing edge of the recording paper P passes the nip region, the nip force acting between the conveying roller 94 and the pressure roller 95 is released, and a biasing force of the pressure roller 95 is exerted on the trailing edge of the recording paper P, whereby the recording paper P is pushed toward the conveying direction. Due to the biasing force, the recording paper P is conveyed by a predetermined line feed pitch or more, e.g., suffers from so-called skipping. When such skipping occurs, the recording position of the recording paper P is displaced in the sub-canning direction (conveying direction), and in a case of margin less image recording, the resulting recorded image may suffer from non-uniformity or print dropout.

To address this issue, one known control method may be employed to control the conveying roller 94, so as to convey, when the trailing edge of the recording paper P passes through the nip region, the recording paper P by a line feed pitch, which is less than the predetermined line feed pitch by any expected amount of skipping for the recording paper P. Through such control, even when the recording paper P skips, the line feed pitch is not increased, such that the resulting recorded image is protected from print dropout.

Alternatively, another known control method may be employed in which a conveying error is determined through the detection of an amount of skipping of the recording paper P, and the conveying error is corrected. Specifically, the conveying error is determined using the rotation amount of the conveying roller 94 on the downstream side of the conveying roller 94 and the pressure roller 95, e.g., when skipping is observed on the recording paper P, the conveying roller 94 is being rotated more often than is necessary for the predetermined line feed pitch. Thus, the conveying error may be determined from the rotation amount. When the conveying error is determined, instead of normal image recording using the recording head 91 as described above, control is applied so that the recording paper P is conveyed in the opposite direction by the conveying error before the recording head 91 scans. Thus, the resulting recorded image may be protected from non-uniformity or print dropout even when the recording paper P skips.

Nevertheless, the amount of skipping of the recording paper P varies depending on the size, the thickness, the type, or the like of the recording paper P, such that amount of skipping of the recording paper P is not always uniform. For example, as shown in FIG. 23, each conveying roller 94 is provided with four pressure rollers 95 disposed at regular intervals in the axial direction. Each of the pressure rollers 95 is biased toward the conveying roller 94, e.g., via a spring (not shown). The conveying roller 94 and the pressure rollers 95 abut each other on their roller surfaces so that nip regions N are formed therebetween. The biasing forces of the pressure rollers 95 do not always result in the same amount of skipping to the recording paper P, and the amount of skipping observed on the recording paper P varies depending on the image recording device. Moreover, the amount of skipping varies depending on the size, the thickness, the type, or the like of the recording paper P. As such, the amount of skipping of the recording paper P is affected by the pressure rollers 95 and the properties of the recording paper P. Therefore, it is difficult to correct an amount of skipping of the recording paper P using one fixed, estimated value in every image recording device.

To determine the amount of skipping of the recording paper P by the rotation amount of the conveying roller 94, the movement of the recording paper P has to match the rotational movement of the conveying roller 94. This requires applying the biasing force using the pressure rollers 95 for the purpose of bringing the recording paper P in to contact with the downstream conveying roller 94. Nevertheless, because the pressure rollers 95 contact the recording surface of the recording paper J which just was printed upon by the recording head 91, if too much biasing force is applied, a nip mark by the pressure rollers 95 remains on the resulting recorded image. Moreover, to convey the recording paper P in the opposite direction using the amount of skipping as a conveying error, the conveying roller 94 needs to rotate in the opposite direction. This requires control over a drive system with consideration given to backlash between gears of a drive transmission mechanism, making operation of image recording device complicated.

SUMMARY OF THE INVENTION

Therefore, a need has arisen for image recording devices that overcome these and other shortcomings of the related art.

A technical advantage of the present invention is that an amount of skipping of a recording medium is determined, and the skipping of the recording medium readily is corrected.

According an embodiment of the present invention, an image recording device comprises a conveying mechanism disposed in a predetermined conveying path comprising a plurality of rollers for conveying a recording medium by a predetermined conveying distance while nipping the recording medium, and a recording unit for recording an image to the recording medium over the predetermined conveying distance. The image recording device also comprises an upstream-side trailing edge detector disposed on art upstream side of the plurality of rollers for detecting a trailing edge of the recording medium based on a sensor signal generated by a first sensor which senses a presence of the recording medium, and a downstream-side trailing edge detector disposed on a downstream side of the plurality of rollers for detecting the trailing edge of the recording medium based on a sensor signal generated by a second sensor which senses the presence of the recording medium. The image recording device further comprises a skip warning region determination unit for determining whether or not the trailing edge of the recording medium is located in a skip warning region, which region comprises the positions of the plurality of rollers, based on a distance by which the conveying mechanism conveys the recording medium after the upstream-side trailing edge detector detects the trailing edge of the recording medium. Moreover, the image recording device comprises a storage unit for storing a correction value table comprising at least one predetermined correction value, and a correction unit for receiving the at least one predetermined correction value from the correction value table, and for correcting the predetermined conveying distance for the conveying mechanism when the trailing edge of the recording medium is in the skip warning region. The image recording device also comprises a skipping distance calculation unit for calculating the skipping distance observed on the recording medium based on the predetermined conveying distance before the downstream-side trailing edge detector detects the trailing edge of the recording medium, and based on a detector-to-detector distance on the predetermined conveying path between the upstream-side trailing edge detector and the downstream-side trailing edge detector, and for adjusting the predetermined correction value in the correction value table based on the calculated skipping distance.

Other features and advantages of the present invention will be apparent to persons of ordinary skill in the art in view of the following detailed description of the invention and the accompanying drawings.

BRIEF DESCRIPTION OF THE DRAWINGS

For a more complete understanding of the present invention, the needs satisfied thereby, and the features and advantages thereof, reference now is made to the following descriptions taken in connection with the accompanying drawings.

FIG. 10 is a diagram of a correction value table T according to an embodiment of the present invention.

DETAILED DESCRIPTION OF EMBODIMENTS

Embodiments of the present invention and their features and advantages may be understood by referring to FIGS. 1-21, like numerals being used for like corresponding parts in the various drawings.

Figure 1:
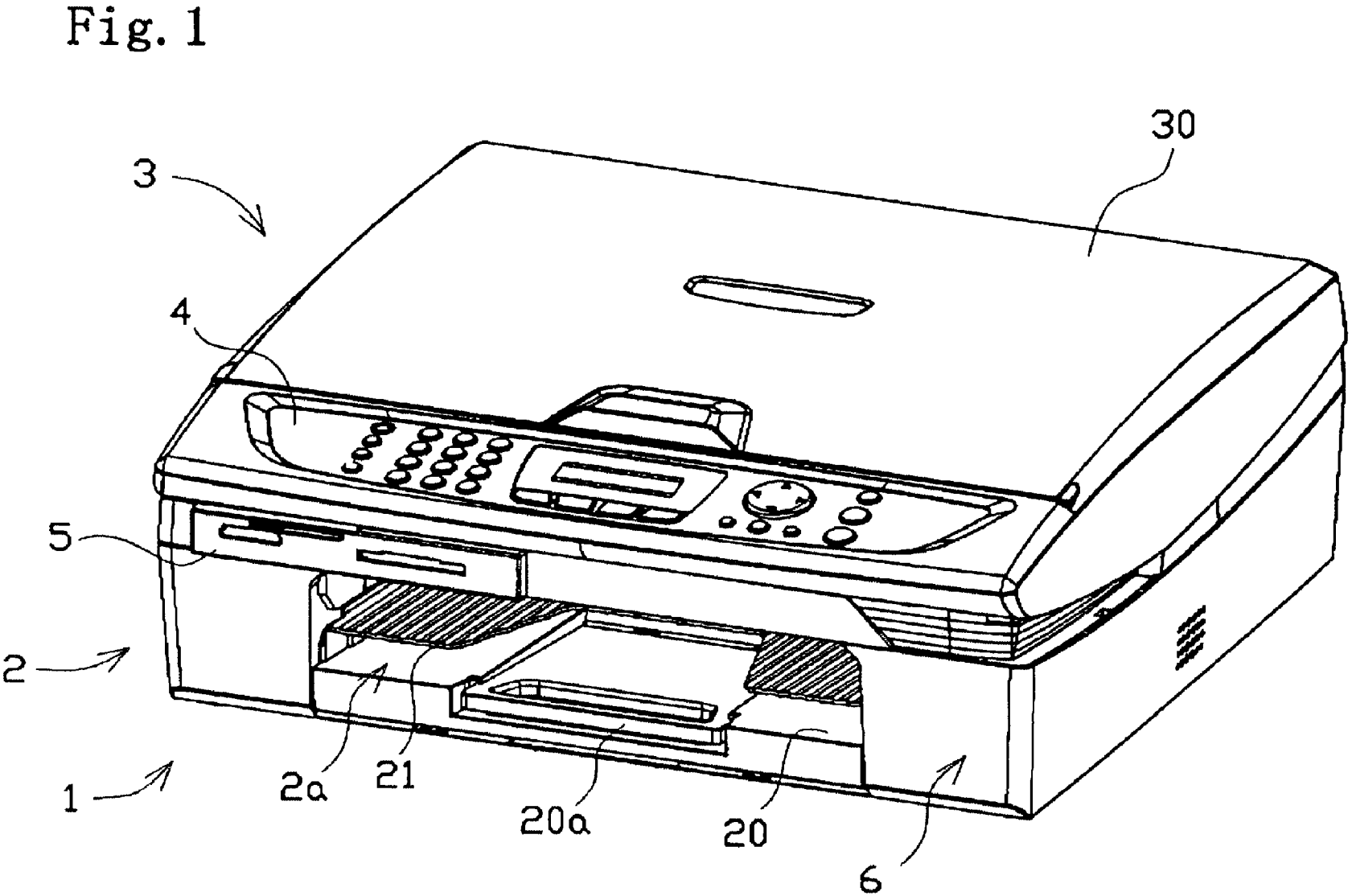
FIG. 1 is a perspective view of a combined device 1 according to an embodiment of the present invention.

FIG. 1 shows a combined device 1 (image recording device) according to an embodiment of the present invention. The combined device 1 may be a Multi Function Device (MFD), e.g., a single piece MFD, and a lower portion may serve as a printer section 2 and an upper portion may serve as a scanner section 3. The combined device 1 may be provided with functions of printing, scanning, copying, or faxing, or a combination thereof. In the combined device 1, the printer section 2 may comprise the image recording device of the present invention, and the functions except that of printing may be omitted from the combined device 1, e.g., combined device 1 may be a single-function printer that does not comprise scanner section 3, and may not perform the functions of scanning and copying.

To use the image recording device of the present invention as a multifunction device, the device may be small in size such as the combined device 1 of this embodiment of the present invention, or may be large in size, e.g., may be provided with a plurality of paper-feeding cassettes or an auto document feeder (ADF). The combined device 1 may be connected to an external information system, such as a computer (not shown), and records images and texts on to a recording paper based on printing data received from the computer, such printing data comprising data and text data. The combined device 1 also may be connected to external equipment such as a digital camera or the like, for recording of image data received from the digital camera on to a recording paper, or may be equipped with various types of recording medium, such as a memory card or the like, for recording of image data from the recording medium on to a recording paper.

Figure 2:
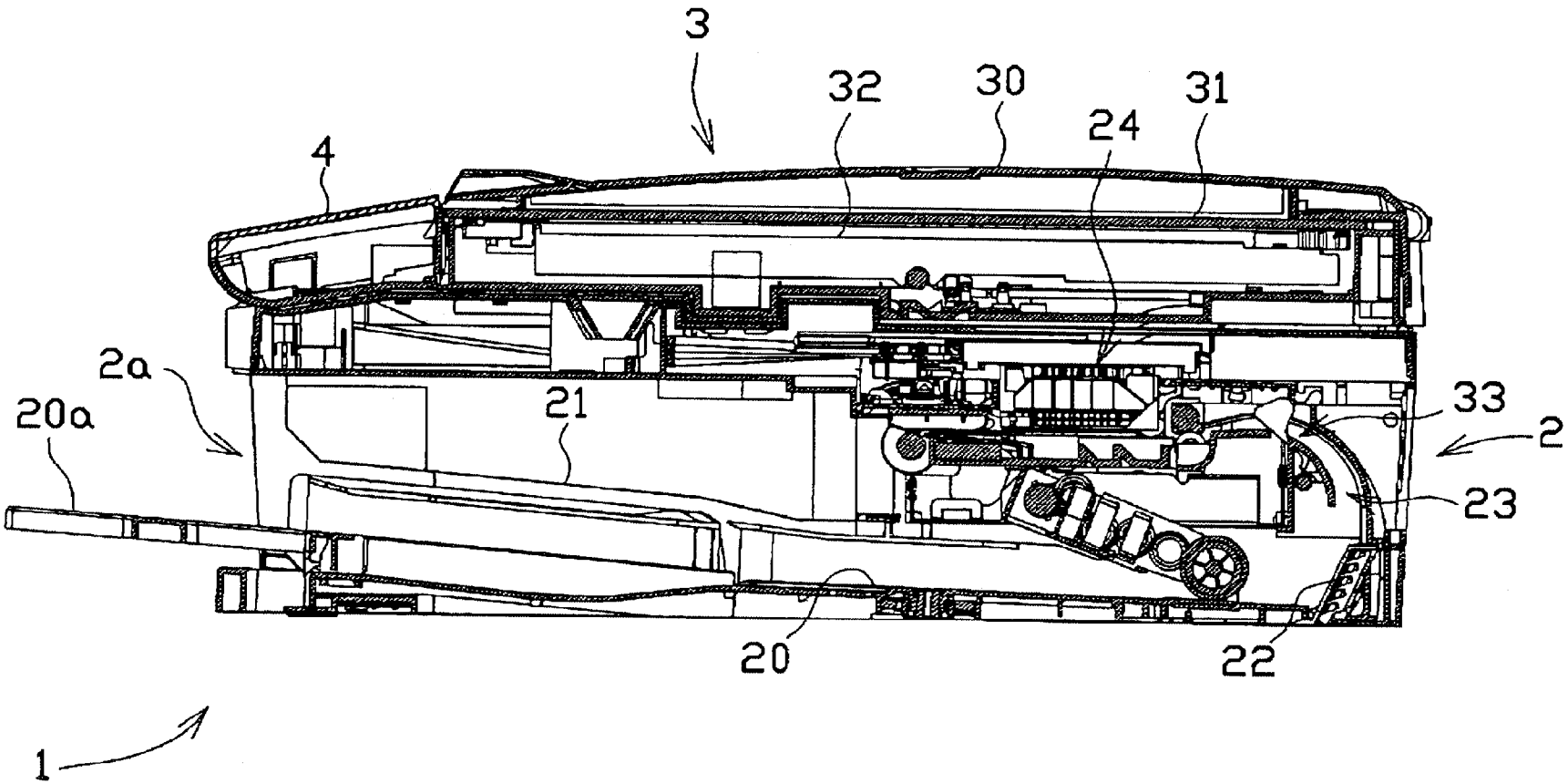
FIG. 2 is a vertical, cross-sectional view of the combined device of FIG. 1.

As shown in FIG. 1, the combined device 1 may have substantially the outer shape of a rectangular parallelepiped, and may have a low-profile with greater depth and breadth. The lower portion of the combined device 1 may be the printer section 2. The printer section 2 may be formed with an aperture 2*a* at the front, and a paper-feed tray 20 and a paper-eject tray 21 may form a two-tier in such a manner as to be partially exposed from the aperture 2*a*. The paper-feed tray 20 may be provided for storing a recording paper, e.g., the recording medium, and may be configured to accommodate various sizes of recording paper that are smaller than A4 size, e.g., B5 size, card size or the like. As shown in FIG. 2, the tray surface of the paper feed tray 20 may be increased in size by pulling out a slide tray 20*a*. The recording paper accommodated in the paper feed tray 20 may be fed inside the printer section 2, may be recorded with any desired image, and may be ejected to the paper-eject tray 21.

The upper portion of the combined device 1 may be the scanner section 3, which may be configured as a so-called flatbed scanner. As shown in FIGS. 1 and 2, beneath a document cover 30 provided to serve as a top of the combined device 1 and configured to freely open and close, a platen glass 31 and an image sensor 32 may be provided. The platen glass 31 may be provided for carrying thereon a document for image reading. Beneath the platen glass 31, the image sensor 32 may be provided to scan in the width direction of the combined device 1. The main scanning direction of the image sensor 32 may be the depth direction of the combined device 1.

The upper front portion of the combined device 1 may be provided with an operation panel 4 used to operate the printer section 2 and the scanner section 3. The operation panel 4 may comprise various operation buttons and a liquid crystal display section. The combined device 1 operates based on an operation command received via the operation panel 4, and if the combined device 1 is connected to a computer, also may operate based on a command received from the computer via a printer driver or a scanner driver. The upper left portion of the combined device 1 may be provided With a slot section 5 that may be configured to receive various types of recording medium, e.g., a memory card. Using the operation panel 4, inputs may be made for reading image data on a memory card disposed in the slot section 5, for displaying information about the image data on the liquid crystal display section, and for instructing the printer section 2 to print an image to a recording paper.

Referring to FIGS. 2 to 9, the printer section 2 is described. As shown in FIG. 2, on the deep side of the paper-feed tray 20 provided on the bottom side of the combined device 1, a separator tilt plate 22 may be disposed to separate and to guide upward the recording paper placed on the paper-feed tray 20. A conveying path 23 first may be directed upward from the separator tilt plate 22, then may bend toward the front, then may extend from the back side of the combined device 1 toward the front, and then may reach the paper-eject tray 21 after passing an image recording section 24. With such a configuration, the recording paper on the paper-feed tray 20 may be guided by the conveying path 23 as if mating a U-turn upward from downward direction before reaching the image recording section 24. After the imager recording section 24 performs image recording, the recording paper is ejected to the paper-eject tray 21.

Figure 3:
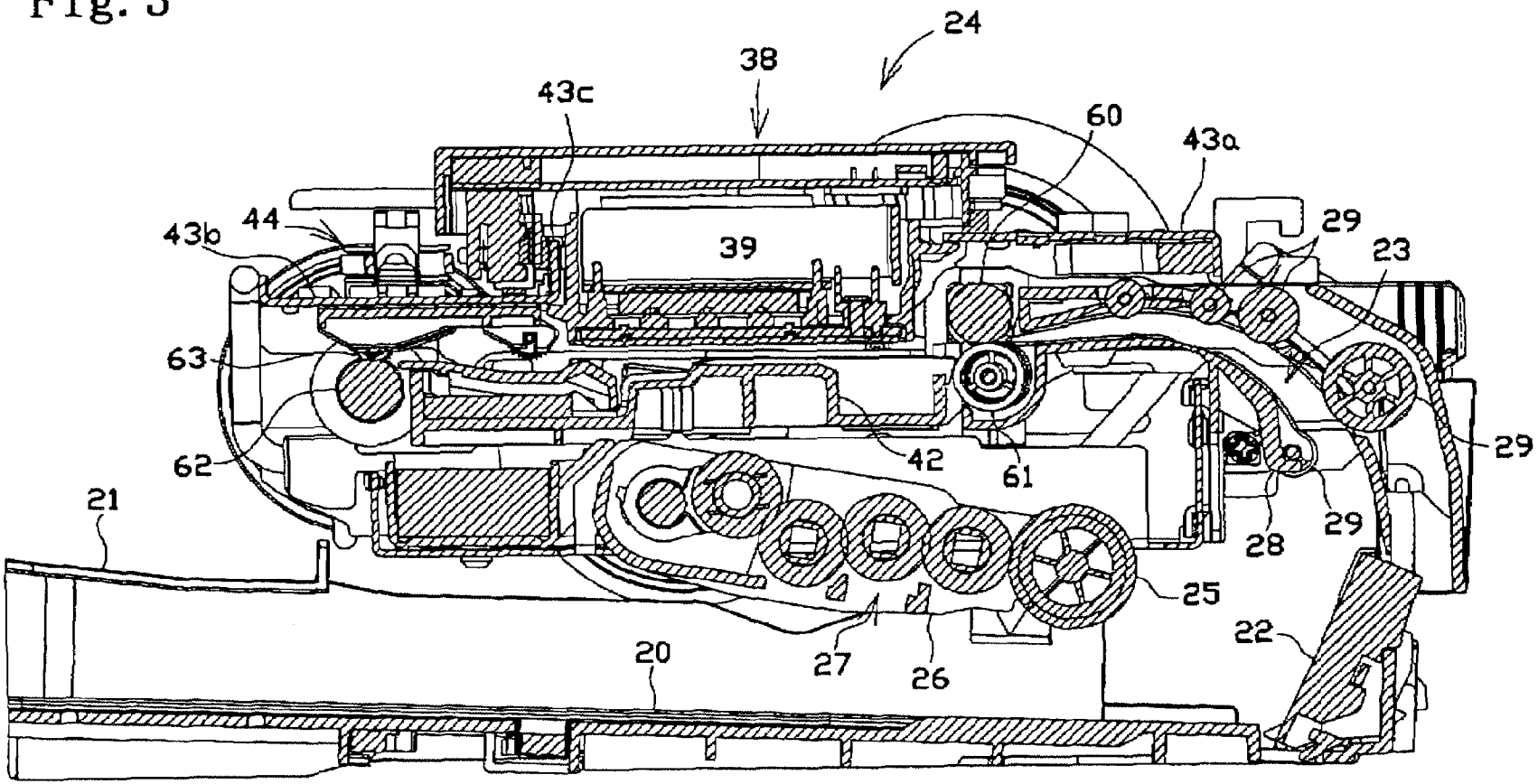
FIG. 3 is an enlarged, cross-sectional view of a printer section of the combined device of FIG. 1.

As shown in FIG. 3, on the upper side of the paper-feed tray 20, a paper-feed roller 25 may be provided for separately conveying the recording paper on the paper-feed tray 20, one by one, for supply to the conveying path 23. The paper-feed roller 25 rotates by the driving movement of a motor 71, such as an LP motor (FIG. 9) transferred by a drive transfer mechanism 27, which may comprise a plurality of gears that engage each other. The paper-feed tray 20 may be pivotally supported at the front edge of a paper-feed arm 26. The paper-feed arm 26 moves in the vertical direction to move closer to or to move away from the paper-feed tray 20.

The paper-feed arm 26 may be disposed to freely swing vertically at the base end.

In a stand by state, the paper-feed arm 26 may be lifted upward by a paper-feed clutch or a spring (not shown), and swings downward to feed the recording paper. When the paper-feed arm 26 moves downward as such, the paper-feed roller 25 pivotally supported at the front end thereof may be pressed against the surface of the recording paper on the paper-feed tray 20. By the paper-feed roller 25 rotating in this state, the motion force generated between the roller surface of the paper-feed roller 25 and the recording paper moves the recording paper forward at the top to the separator tilt plate 22. The recording paper abuts the separator tilt plate 22 at its front end and thus is guided upward for supply to the conveying path 23. When the recording paper at the top is moved by the paper-feed roller 25, the recording paper therebeneath may also may be moved under the influence of friction or static electricity. Even with this being the case, however, the therebeneath recording paper is stopped by abutting the separator tilt plate 22.

Other than the portion formed with the image recording section 24, the conveying path 23 may comprise by an external guide surface and an internal guide surface, which oppose each other with a predetermined space formed therebetween. For example, the external guide surface may be formed as a piece with the frame of the combined device 1, and the internal guide surface may comprise a guide member 28 fixed inside the frame. On the conveying path 23, e.g., on the bent portion of the conveying path 23, transfer rollers 29 may be provided to freely rotate in the axial direction, e.g., the width direction, of the conveying path 23. The transfer rollers 29 may expose their roller surfaces toward the external guide surface or the internal guide surface. The transfer rollers 29 help smoothly move the recording paper abutting the guide surface at the bent conveying path 23.

Figure 4:
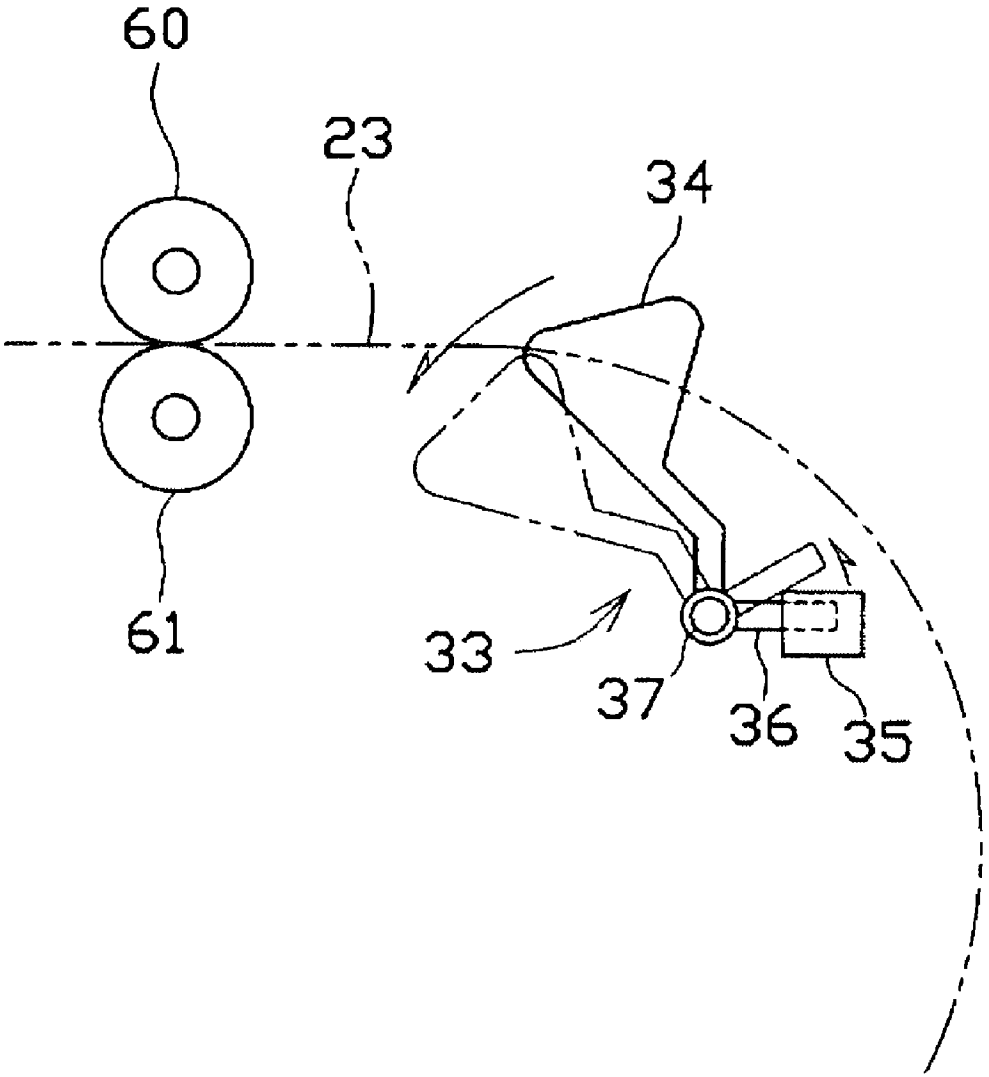
FIG. 4 is an enlarged, schematic diagram of a registration sensor of the combined device of FIG. 1.
Figure 9:
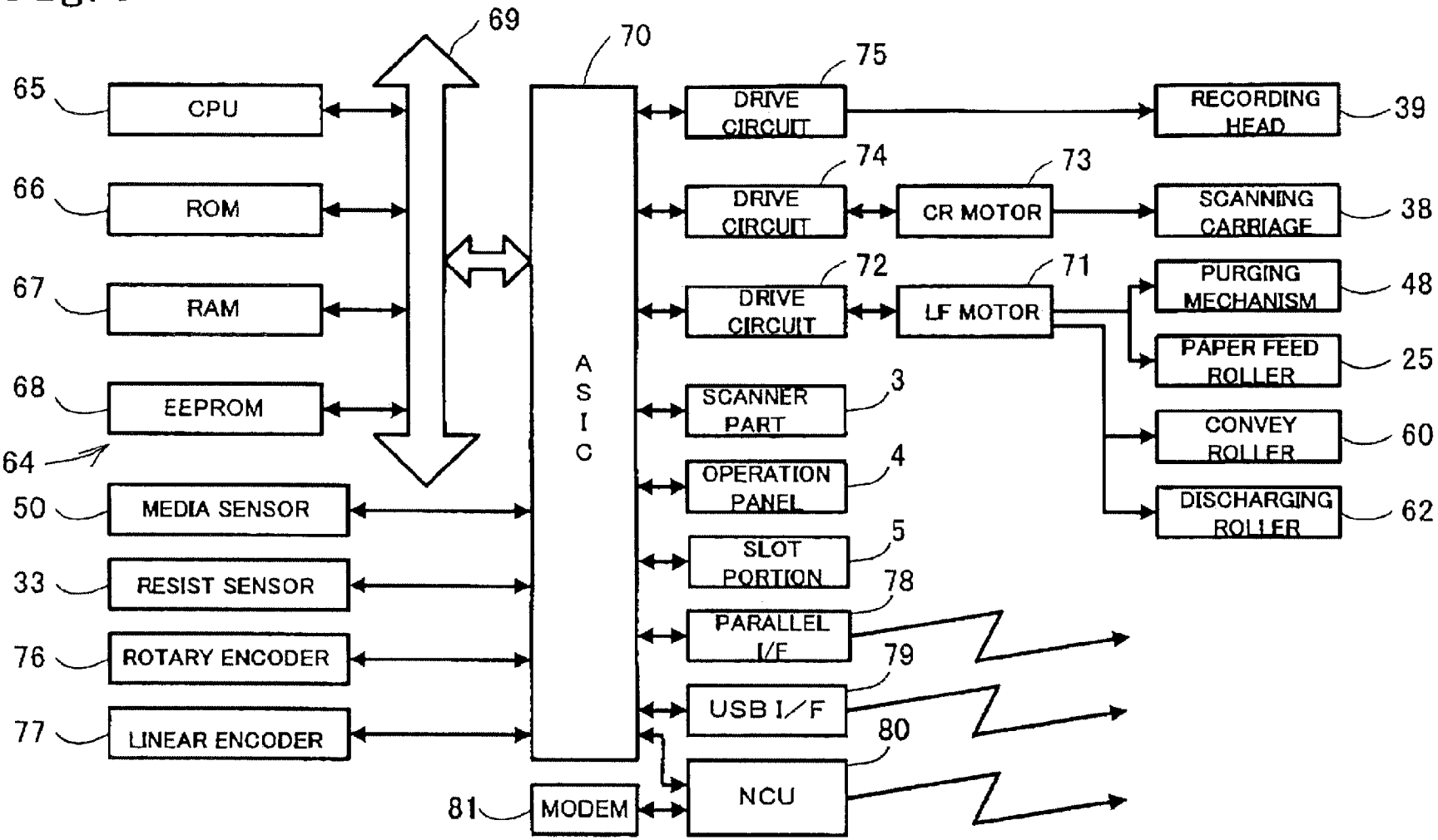
FIG. 9 is a block diagram a control section of the combined device of FIG. 1.

On the conveying path 23 after making a U-turn made from downward to upward, a registration sensor 33 may be provided on the upstream from the image recording section 24. The registration sensor 33 may comprise the upstream-side trailing edge detector of the present invention and a control section 64 of the combined device 1 (FIG. 9). As shown in FIGS. 2 and 4, the registration sensor 33 may comprise a detector member 34 and a photo interrupter 35. The detection member 34 may protrude towards the conveying path 23, and may rotate to be offset from the conveying path 23 by contacting the incoming recording paper. The photo interrupter 35 detects the rotation movement of the detection member 34. The detection member 34 may be a piece with a shielding section 36 that is to be detected by the photo interrupter 35, and may freely rotate about an axis 37, The detection member 34 may be elastically biased by biasing means, e.g., a spring (not shown), at a position where the detection member 34 is protruding to the conveying path 23, e.g., in a clockwise direction in the drawing. Accordingly, in a state where the detection member 34 does not receive an external force, as shown in the drawing, the detection member 34 protrudes to the conveying path 23, and the shielding section 36 is positioned between a light-emitting section and a light-receiving section of the photo interrupter 35. In this state, light transmission by the photo interrupter 35 is blocked, and the registration sensor 33 is deactivated. When the recording paper is forwarded on to the conveying path 23, the recording paper abuts the detection member 34. After the recording paper moves further forward, the detection member 34 rotates to be offset from the conveying path 23. The shielding section 36 is rotated together with the detection member 34, and the shielding section 36 moves away from the position between the light-emitting section and the light-receiving section of the photo interrupter 35. This releases the blocking of the light transmission by the photo interrupter 35 so that the registration sensor 33 is turned on. In response to the registration sensor 33 being turned on or off, the control section 64 detects the trailing edge of the recording paper on the upstream from the conveying roller 60.

As shown in FIG. 3, the image recording section 24 may be provided on the downstream from the registration sensor 33. The image recording section 24 may comprise a scanning carriage 38, which may comprise a recording head 39 and reciprocates in the main scanning direction. The recording head 39 receives an ink supply from an ink tank 40 (FIG. 5) through an ink supply tube 41. The ink tank 40 may be disposed in the combined device 1 separately from the recording head 39, and the ink supply may comprise various colors of ink, e.g., cyan (C), magenta (M), yellow (Y), and black (Bk). The recording head 31 may discharge the ink in the form of a droplet. Through scanning by the scanning carriage 38, the recording paper disposed proceeding on a platen 42 may be recorded with images.

Figure 5:
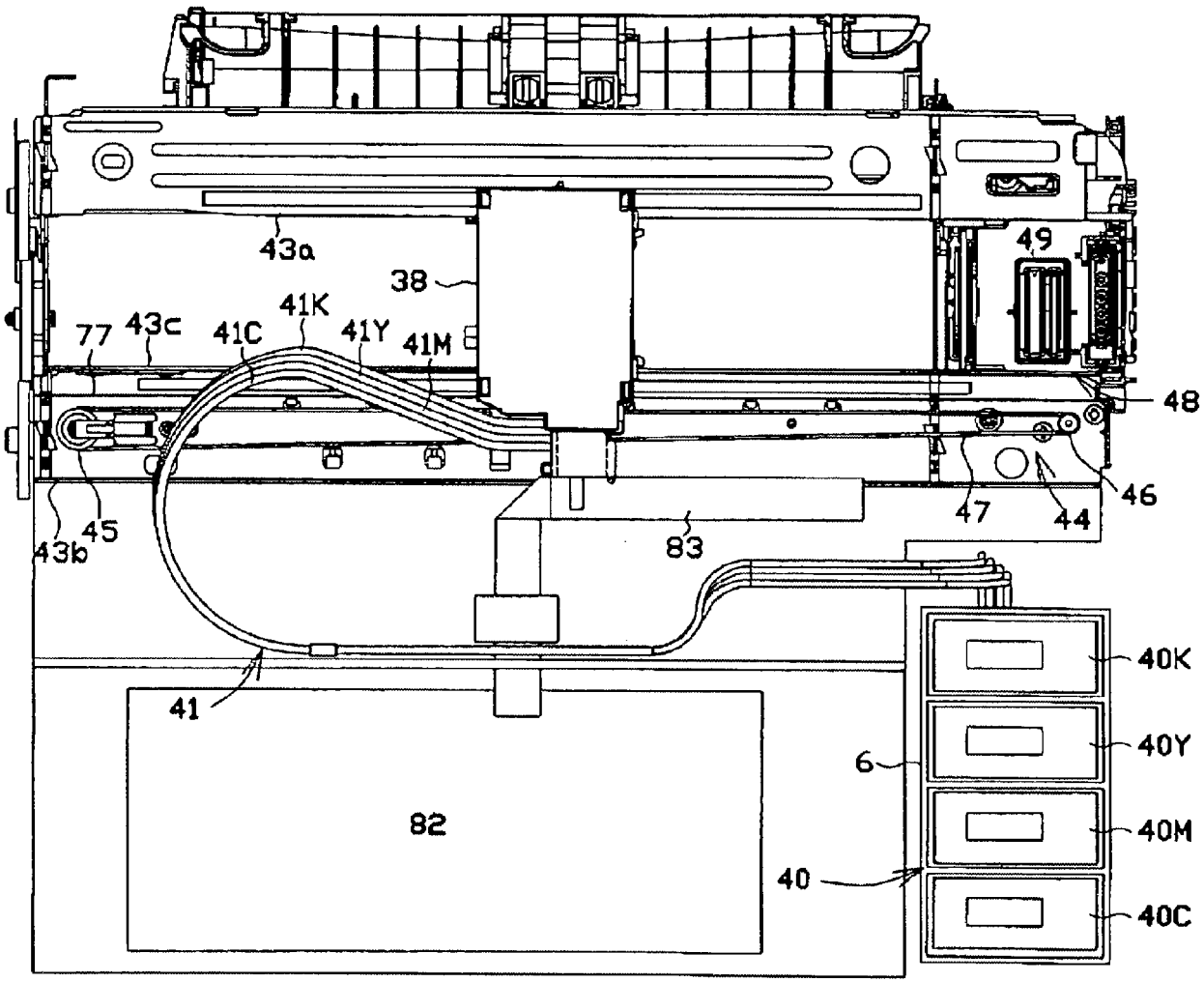
FIG. 5 is a plane view of a scanning carriage of the combined device of FIG. 1.

In more detail, as shown in FIG. 5, on the upstream portion of the conveying path 23, a pair of guide rails 43*a* and 43*b* may extend in the width direction of the conveying path 23 at predetermined intervals in the conveying direction of the recording paper. The scanning carriage 38 may be disposed across the guide rails 43*a* and 43*b* to freely slide. The guide rail 43*a* disposed on the upstream in the conveying direction of the recording paper may be flat, and the length in the width direction of the conveying path 23 may be longer than the scanning width of the scanning carriage 38. The upper surface of the guide rail 43*a* may support the upstream end portion of the scanning carriage 38 to freely slide.

The guide rail 43*b* disposed on the downstream in the conveying direction of the recording paper also may be flat, and the length in the width direction of the conveying path 23 may be almost the same as the guide rail 43*a*. An edge portion 43*c* supporting the downstream end portion of the scanning carriage 38 way bend upward at substantially 90 degrees. The scanning carriage 38 may be supported by the upper surface of the guide rail 43*b* to freely slide thereon, and nips the edge portion 43*c* using rollers or the like (not shown). As such, the scanning carriage 38 may be supported on the guide rails 43*a* and 43*b* to freely slide, and reciprocates in the width direction of the conveying path 23 relative to the edge portion 43*c* of the guide rail 43*b*. Moreover, a slide member may be provided at a portion where the scanning carriage 38 makes contact with the upper surfaces of the guide rails 43*a* and 43*c*, for friction reduction.

The guide rail 43*b* may carry thereon with a belt drive mechanism 44. The belt drive mechanism 44 may comprise a timing belt 47 stretched between a drive pulley 45 and a follower pulley 46. The timing belt 47 may be ring-shaped with teeth inside, and the drive pulley 45 and the follower pulley 46 may be provided in the vicinity of ends of the conveying path 23, respectively. The drive pulley 45 axially receives the drive force from a motor 73, e.g., a CR motor, and when the drive pulley 45 rotates, the timing belt 47 responsively moves around the pulleys.

The scanning carriage 38 may be fixed to the timing belt 47, and in response to the timing belt 47 going around the pulleys, the scanning carriage 38 reciprocates on the guide rails 43*a* and 43*b* relative to the edge portion 43*c*. Such a scanning carriage 38 may comprise the recording head 39, such so that the recording head 39 also reciprocates in the main scanning direction, e.g., the width direction of the conveying path 23. A strip-like linear encoder 77 (FIG. 9) may be disposed along the edge portion 43*c*. Detecting the linear encoder 77 using the photo interrupter controls the reciprocating movement of the scanning carriage 38.

As shown in FIG. 3, beneath the conveying path 23, the platen 42 may be disposed to oppose the recording head 39. The platen 42 may be disposed to the reciprocating area of the scanning carriage 38, e.g., over the center portion thereof across which the recording paper moves. The width of the platen 42 may be substantially wider than the maximum width of a recording paper of any allowable size, and thus, the ends of the recording paper pass over the platen 42. The upper surface of the platen 42 supporting the recording paper may be of a color having a reflectivity that is different than white which is the general color for the recording paper. For example, the upper surface of the platen 42 may be black.

As shown in FIG. 5, in the area where no recording paper passes, e.g., in the area to be recorded with no image by the recording head 39, maintenance units may be disposed, comprising a purge mechanism 49, a waste ink tray (not shown), or the like. The purge mechanism 48 may be provided for removing air bubbles and foreign substances by suction from nozzles 53 of the recording head 39 or the like. The purge mechanism 48 may comprise a cap 49 covering the nozzle surface of the recording head 39, a pump mechanism (not shown) that is connected to the recording head 39 via the cap 49, and a moving mechanism (not shown) for contacting the cap 49 with the nozzle surface of the recording head 39. To remove any air bubbles from the recording head 39 by suction, the scanning carriage 38 may be moved so that the recording head 39 moves above the cap 49. In this state, the cap 49 moves upward to tightly close an ink discharge port 53*a* (FIG. 6) formed on the bottom surface of the recording head 39. Through the pump coupled to the cap 49, the ink is sucked from the nozzles 53 of the recording head 39.

Although not shown, the waste ink tray may be also provided in the area within the reciprocating range for the scanning carriage 38 but beyond the image recording range. The waste ink tray may be used to receive any empty discharges of ink (called flashing) from the recording head 39. The maintenance units are in charge of maintenance of removing air bubbles or color-mixed ink in the recording head 39, for example, As shown in FIG. 1, the ink tank 40 may be housed in an ink tank housing section 6, which is disposed in a cabinet provided on the left front side (right front side in the drawing) of the printer section 2. As shown in FIG. 5, in the device, the ink tank 40 may be provided separately from the scanning carriage 38, and the scanning carriage 38 may be configured to receive ink supply via the ink supply pipe 41.

The ink tank 40 may comprise four ink tanks of 40C, 40M, 40Y, and 40K storing inks of cyan (C), magenta (M), yellow (Y), and black (Bk), respectively. The four ink tanks may be loaded at their corresponding positions inside of the ink housing section 6 in the device cabinet. Although not shown in detail, the ink tanks 40C, 40M, 40Y, and 40K may be a cartridge type, may be filled with a corresponding color of ink in a synthetic-resin-made case, and may be detachable from the upper portion of the ink housing section 6. The cases of the ink tanks 40C, 40M, 40Y, and 40K each may be formed at the bottom portion with an aperture for supplying of various inks in storage. The apertures may each sealed by a check valve. The ink, housing section 6 may be formed with a junction section for opening the check valve. When the ink tanks 40C, 40M, 40Y, and 40K are loaded into the ink housing section 6, the check valves of the apertures may be responsively opened for ink supply from the apertures.

Those of ordinary skill in the art readily will understand, however, the number of ink colors is not restrictive, and that the number of the ink tanks 40 may be increased, e.g., to 6 to 8 ink tanks. Similarly, the ink tank 40 is not restrictive to be of a cartridge, and may be fixedly disposed in the device cabinet to be filled with ink whenever desired.

From the ink tanks 40C, 40K 40Y, and 40K, various colors of ink may be supplied to the ink supply tubes 41 provided for each of the colors, e.g., 41C, 41M, 41Y, and 41K. The ink supply tubes 41C, 41M, 41Y, and 41K each may be a synthetic-resin-made tube, and may be made flexible so as to deform at the time of scanning by the scanning carriage 38. Although not shown in detail, as to the ink supply tubes 41C, 41MN, 41Y, and 41K, their apertures on one side each may be connected to the junction sections at the position where the ink tanks are disposed in the ink housing section 6. The ink supply tube 41C may be provided for the ink tank 40C, and may supply ink of cyan (C). Similarly, the ink supply tubes 41M, 41Y, and 41K may be provided for the ink tanks 40M, 40Y, and 40K, and may supply ink of magenta (M), yellow (Y), and black (Bk), respectively.

The ink supply tubes 41C, 41M, 41Y, and 41K extending from the ink housing section 6 may be pulled out along the width direction of the device before reaching the center portion, and then may be temporarily fixed to any suitable member, such as the device frame. The portion including the fixed portion to the scanning carriage 38 may not be fixed to the device frame or the like, and may change in posture to follow the reciprocating movement of the scanning carriage 38. More specifically, as the scanning carriage 38 moves toward one of the reciprocating direction (left in the drawing), the ink supply tubes 41C, 41M, 41Y, and 41K may move together with the scanning carriage 38 while being deformed as if reducing the bending radius of the U-shaped curved portion. On the other hand, as the scanning carriage 38 moves toward the other of the reciprocating direction (right in the drawing), die ink supply tubes 41C, 41M, 41Y, and 41K may move together with the scanning carriage 38 while being deformed as if increasing the bending radius of the U-shaped curved portion.

Figure 6:
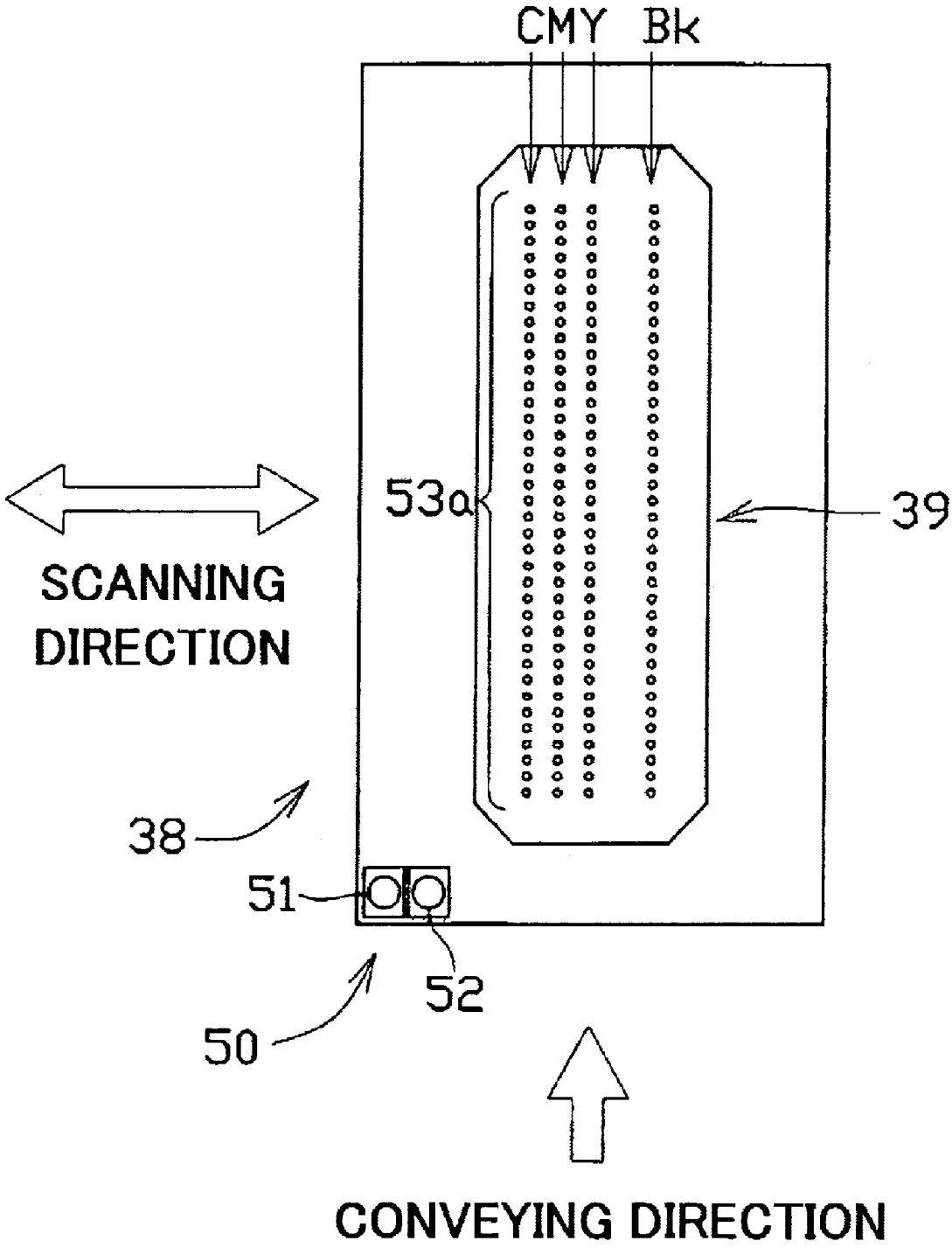
FIG. 6 is a bottom view of the scanning carriage of the combined device of FIG. 1.
Figure 7:
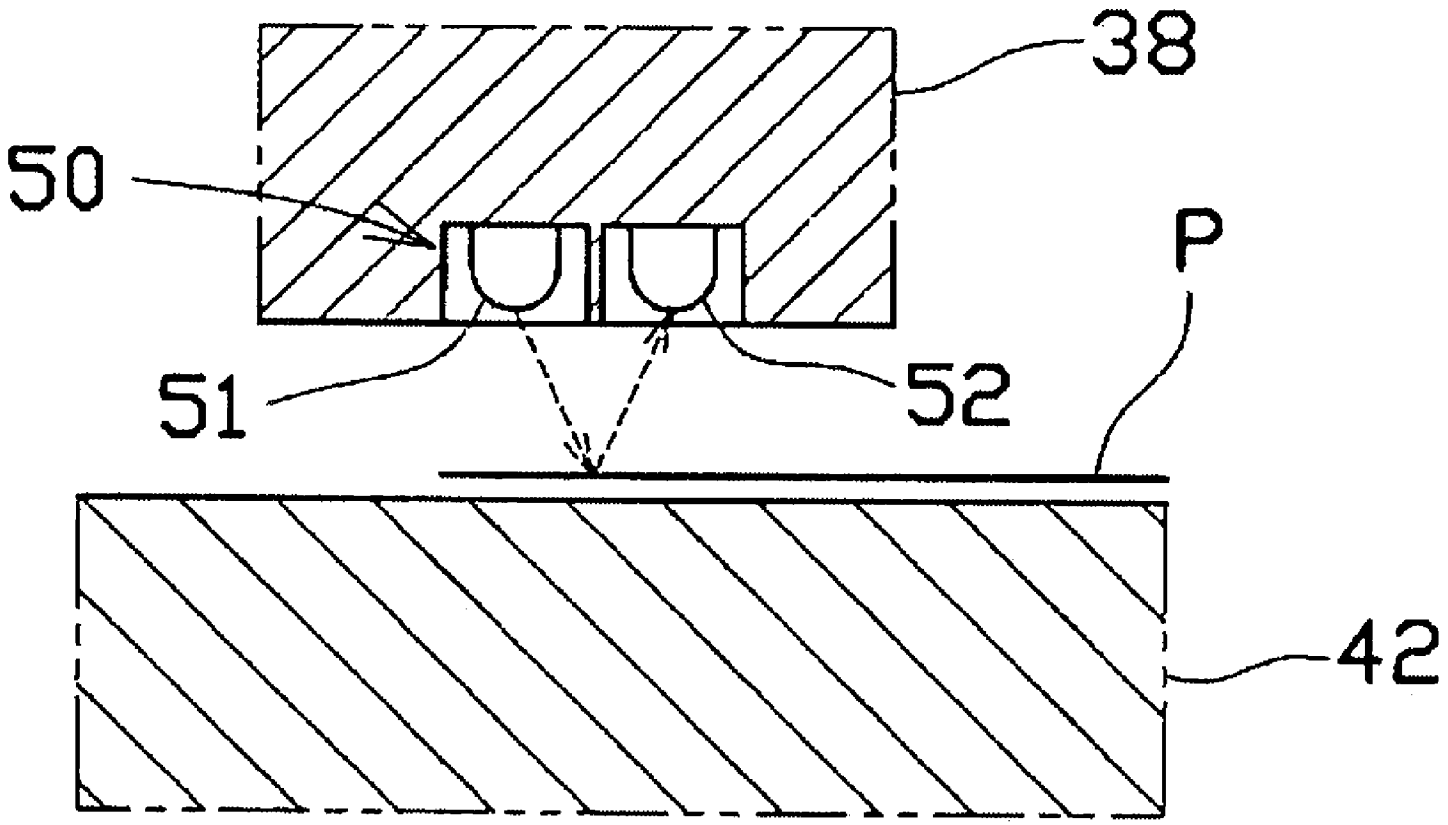
FIG. 7 is a partial, cross-sectional view a media sensor of the combined device of FIG. 1.

As shown in FIG. 6, the scanning carriage 38 may further comprise a media sensor 50 The media sensor 50 may comprise the downstream-side trailing edge detector of the present invention and the control section 64 of the combined device 1. As shown in FIGS. 6 and 7, the media sensor 50 also may comprise a light-emitting section 51, e.g., being a light-emitting diode, and a light-receiving section 52 being an optical sensor. As shown in FIG. 7, the light-emitting section 51 of the media sensor 50 irradiates light toward the platen 42, and the light-receiving section 52 receives the reflected light When there is no recording paper P, the light-receiving section 52 receives the reflected light from the low-reflective platen 42, and the detection value (AD value) of the media sensor 50 is low On the other hand, when there is a recording paper P, the light-receiving section 52 receives the reflected light from the high-reflective recording paper P, and the detection value (AD value) of the media sensor 50 is high. As shown in FIG. 6, the media sensor 50 may be mounted to the scanning carriage 38 on one end side of the scanning direction being upstream in the conveying direction of the recording head 39, and may reciprocate in the scanning direction by the movement of the scanning carriage 38. As such, by providing the scanning carriage 38 with both the recording head 39 and the media sensor 50, there is no need to include a scanning carriage for scanning the media sensor 50 separately from the scanning carriage 38 including the recording head 39 for image recording. The number of components is thus reduced in the combined device 1, such that the device may be reduced in size, and the cost of the device may be reduce.

As shown in FIG. 6, the recording head 39 may comprise ink discharge ports 53*a* on the bottom surface in the conveying direction of the recording paper for each color of C, M, Y, and Bk. Here, the ink discharge ports 53*a* are appropriately defined by pitch in the conveying direction and by number with a consideration given to the resolution of recording images or others. The number of lines of the ink discharge ports 53*a* may be increased or decreased depending on how many color inks are to be used.

Figure 8:
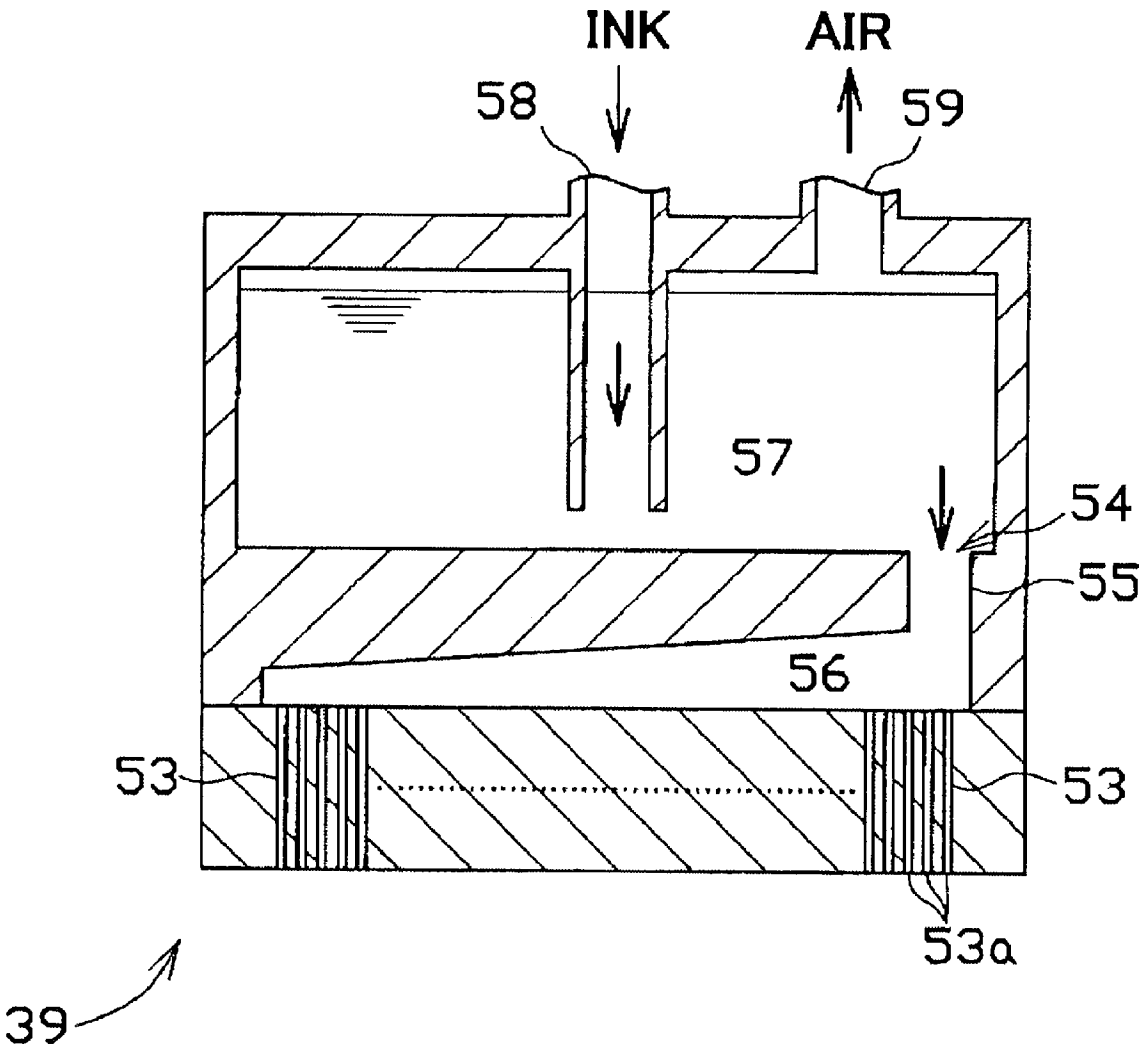
FIG. 8 is a cross-sectional view of a recording head of the combined device of FIG. 1.

As shown in FIG. 8, the nozzles 53 may be arranged in line on the lower portion of the recording head 39, and their lower ends may be opened on the bottom surface of the recording head 39, such that the ink discharge ports 53*a* are formed. On the upper end sides of the nozzles 53, a manifold 54 may be formed over the nozzles 53 provided for each color of the ink. The manifold 54 may comprise a supply tube 55 and a manifold chamber 56, and the ink coming from the supply tube 55 may be distributed to the nozzles 53 via the manifold chamber 56. Here, the supply tube 55 is formed on one end side of a group of nozzles 53, and the manifold chamber 56 is formed over the upper ends of the nozzles 53.

The surface of the manifold chamber 56 opposing the nozzles 53 may be tilted downward, e.g., toward downstream where ink flows, to reduce the cross-sectional area of the manifold chamber 56 toward downstream. The nozzles 53 may be any known mechanism for discharging, droplets of ink, e.g., a mechanism for discharging droplets of ink utilizing deformation of side walls of the nozzles 53 made of a piezoelectric material.

On the upper side of the manifold 54, buffer tanks 57 may be disposed. Similarly to the nozzles 53 and the manifold 54, the buffer tank 57 may be provided for each ink color of C, M, Y, and Bk. As shown in FIG. 5, the buffer tank 57 may be supplied with ink from the ink tank 40 via the ink supply tube 41 and then an ink supply port 58. As such, as an alternative to ink supply directly from the ink tank 40 to the nozzles 53, the ink may be temporarily stored in the buffer tank. 57 so that any air bubbles generated in the ink on the way to the ink supply tubes 41 or the like may be captured. Therefore, the nozzles 53 may be free therein from air bubbles. The air bubbles captured in the buffer tank 57 may be ejected from an air bubble ejection port 59 by suction by the pump mechanism.

The buffer tank 57 may be connected to the manifold chamber 56 via the supply tube 55. This forms a channel to flow various colors of ink coming from the ink tank 40 to the nozzles 53 via the buffer tank 57 and the manifold 54. The colors of ink, e.g., C, M, Y, and Bk, coming through such a channel may be discharged on the recording paper from the ink discharge ports 53*a* in the form of a droplet.

As shown in FIG. 3, the conveying roller 60 and the pressure roller 61 may be provided as a pair of rollers on the upstream from the image recording section 24 but downstream from the registration sensor 33. The conveying and pressure rollers 60 and 61 nip the recording paper proceeding on the conveying path 23, and direct the paper on to the platen 42. On the downstream from the image recording section 24, a paper ejection roller 62 and a spike roller 63 may be provided as a pair of rollers. The paper-ejection and spike rollers 62 and 63 nip and convey the recorded recording paper. The conveying roller 60 and the paper ejection roller 62 receive the drive force from the LF motor 71, and may be intermittently driven with a predetermined line feed pitch. The rotation movement of the conveying roller 60 may be synchronized with that of the paper ejection roller 62. Detecting a rotary encoder 76 (FIG. 9) provided to the conveying roller 60 using the photo interrupter controls the rotation movement of the conveying roller 60 and the paper ejection roller 62. Based on the encoder amount of the rotary encoder 76, the control section 64 of the combined device 1 may be configured to calculate the distance covered by the conveying roller 60 to convey the recording paper.

The pressure roller 61 may be configured to freely rotate by being biased to thrust the conveying roller 60 with a predetermined thrust force. When the recording paper proceeds between the conveying roller 60 and the pressure roller 61, the pressure roller 61 backs off by the thickness of the recording paper, and nips the recording paper together with the conveying roller 60. This allows the rotation force of the conveying roller 60 to reliably be transmitted to the recording paper. Although the spike roller 63 is provided similarly to the paper ejection roller 62, with the reason of closely abutting the printed recording paper, its roller surface may be made uneven, e.g., spike-like, not to degrade the images recorded on the recording paper. The conveying mechanism of the present invention may comprise such components, e.g., the conveying roller 60, the pressure roller 61, the paper ejection roller 62, the spike roller 63, and the paper feed roller 25.

FIG. 9 shows the control section 64 of the combined device 1. The control section 64 exercises control over the combined device 1, e.g., not only over the scanner section 2 but also over the printer section 3. The control section 64 may comprise a microcomputer comprising a CPU 65, a ROM 66, a RAM 67, and an EEPROM 68 (storage unit), and may be connected to an ASIC (Application Specific Integrated Circuit) 70 via a bus 69. The control section 64 may implement a skip warning region determination unit, a storage unit, a correction unit, and a skipping amount calculation unit.

The ROM 66 may store a program or the like for controlling the combined device 1 in terms of various operations. The RAM 67 serves as a storage region or working area for temporarily carrying various types of data for use by the CPU 65 at the time of program execution. The EEPROM 68 may store a correction value table T comprising a predetermined correction value A(s,t) to account for skipping observed on the recording paper. The skipping amount as a result of a skipping phenomenon having occurred to the recording paper varies depending on the sizes of the recording paper and/or the paper type t of the recording paper. In consideration thereof, the preset correction value A(s,t) in the correction value table T may be correlated to the size s or the paper type t, such that the correction value A(s,t) may be suited for the actual skipping amount.

As shown in FIG, 10, the correction value table T may comprise correction values A(s,t), each of which may have a correlation with the size s and the paper type t of the recording paper. The size s denotes the size of the recording paper suitable for image recording by the printer section 2 of the combined device 1, and may include sizes of L, 2L, A5, B5, and A4. Generally, the sizes of L and 2L are suitable for photo printing, and the sizes of A5, B5, and A4 are available for both photo and document printing. The paper type t denotes the type of the recording paper conveyed by the printer section 2, and includes types of plain paper, cardboard, and glossy paper. The plain paper is popularly used for general document printing, and is thinnest of the paper types. The cardboard is thicker than the plain paper, and the glossy paper has a coating applied on the paper surface for photo printing.

Such sizes s and paper types t respectively may be predetermined set with predetermined correction values of a1 to a10. The correction values a1 to a10 each may be equivalent to the skipping amount observed on the corresponding recording paper of the paper type t in the size s. Such value setting may be made through statistical analysis of data about the skipping amounts, which may be derived from tests or the like using the combined device 1. Assuming in this embodiment that the plain paper causes no skipping, the correction value A(s t) is set to 0 for the plain paper in any size. The sizes s and the paper types t in the correction value table T are those shown by way of example, and the correction values of the present invention are not restrictive to the sizes s and the paper types t in the correction value table T.

The ASIC 70 follows a command coming from the CPU 65, and exercises control over the rotation movement of the LP motor 71. That is, for rotation control, the ASIC 70 generates a phase excitation signal or the like for power application to the LF (conveying) motor 71, provides the signal to a drive circuit 72 of the LF motor 71, and forwards a drive signal to the LF motor 71 via the drive circuit 72 for power application.

The drive circuit 72 serves to drive the LF motor 71, which is connected to various components, e.g., the paper feed roller 25, the conveying roller 60, the paper ejection roller 62, and the purge mechanism 48, and forms an electric signal to rotate the LF motor 71 in response to an output signal coming for the ASIC 70. The LF motor 71 rotates in response to the electrical signal, and the rotation force of the LF motor 71 is transmitted to the various components, e.g., the paper feed roller 25, the conveying roller 60, the paper ejection roller 62, and the purge mechanism 48, via a drive mechanism comprising a gear, a drive shaft, and the like.

Similarly, the ASIC 70 follows a command coming from the CPU 65, and exercises control over the rotation movement of the CR motor 73. That is, for rotation control, the ASIC 70 generates a phase excitation signal or the like for power application to the CR (carriage) motor 73, provides the signal to a drive circuit 74 of the CR motor 73, and forwards a drive signal to the CR motor 73 via the drive circuit 74 for power application.

The drive circuit 74 serves to drive the CR motor 73, which is connected to the scanning carriage 38. In response to an output signal coming from the ASIC 70, the drive circuit 74 generates an electrical signal for rotating the CR motor 73. In response to the electrical signal, the CR motor 73 rotates, and the rotation force of the CR motor 73 is transmitted to the scanning carriage 38 via the belt drive mechanism 44 so that the scanning carriage 38 starts scanning.

The drive circuit 75 serves to selectively discharge the ink from the recording head 39 on to the recording paper at a predetermined timing. Based on the drive control procedure provided by the CPU 65, upon reception of the output signal generated in the ASIC 70, the drive circuit 75 drive-controls the recording head 39.

The ASIC 70 may be connected with the registration sensor 33, the rotary encoder 76, the linear encoder 77, and the media sensor 50. The registration sensor 33 is for detecting the recording paper on the conveying path 23, and the rotary encoder 76 is for detecting the rotation amount of the conveying roller 60. The linear encoder 77 is for detecting the movement amount of the scanning carriage 38, and the media sensor 50 is for detecting the presence of the recording paper.

The sensor signal coming from the registration sensor 33 is stored in the RAM 67 via both the ASIC 70 and the bus 69, and based on the program stored in the ROM 66, the CPU 65 refers to the sensor signal to determine whether the recording paper passes thereby or not. This implements the upstream-side trailing edge detector of the present invention The encoder amount of the rotary encoder 76 detected by the photo interrupter is stored in the RAM 67 via both the ASIC 70 and the bus 69, and based on the program stored in the ROM 66, the CPU 65 determines whether the trailing edge position of the recording paper is located in the skip warning region. For such a determination, the CPU 65 uses the trailing edge detection by the registration sensor 33 and the encoder amount This implements the skip warning region determination unit of the present invention.

The sensor signal of the media sensor 50 may be stored in the RAM 67 via both the ASIC 70 and the bus 69, and based on the program stored in the ROM 66, the CPU 65 analyzes the sensor signal to determine the edge portion of the recording paper. This implements the downstream-side trailing edge detector of the present invention. Moreover, based on the sensor signal of the media sensor 50, the CPU 65 defines the recording paper by width or paper type t. This implements the width detector and the medium type detector of the present invention.

Based on the program stored in the ROM 66, the CPU 65 analyzes the sensor signal of the media sensor 50 to define the recording paper by size s and paper type t. The CPU 65 then receives the correction value A(s,t) for the size s and the paper type t from the correction value table T so as to exercise control over the driving movement of the LF motor 71, thereby controlling the rotation movement of the conveying roller 60 and the paper ejection roller 62. This implements the correction unit of the present invention.

Based on the program stored in the ROM 66, the CPU 65 calculates the actual amount of skipping observed on the recording paper. For such calculation, the sensor signal of the registration sensor 33, the sensor signal of the media sensor 50, and the encoder amount of the rotary encoder 76, are used. After such calculation, the CPU 65 updates the correction values of the correction value table T stored in the EEPROM 68. This implements the skipping amount calculation unit of the present invention.

The ASIC 70 is connected with various components, e.g., the scanner section 3, the operation panel 4, a slot section 5, a parallel interface 78, a USB interface 79, and the like. The operation panel 4 is used for issuing operation commands for the combined device 1, and the slot section 5 may receive various types of small-sized memory card. The parallel and USB interfaces 78 and 79 are provided for data exchange with external equipment e.g., a personal computer, via a parallel cable or a USB cable. The ASIC 70 also may be connected with an NCU (Network Control Unit) 80 or a MODEM 81 for implementing the faxing function.

As shown in FIG. 5, the control section 64 may comprise a main substrate 82, from which signal transmission is provided to the recoding head 39 via a flat cable 83. For example, the signals may comprise recording signal and the like. The flat cable 83 may be a thin strip formed by covering, for insulation, an electrical-signal-transmitting conductor with a synthetic resin film, e.g., polyester film, and may be electrically connected with the main substrate 82, and a control substrate (not shown) of the recording head 39. The flat cable 83 may be pulled out from the scanning carriage 38 in the reciprocating direction, and may be vertically bent into the substantially U-shape. This substantially U-shape portion may be fixed to another member, and changes in posture by following the reciprocating movement of the scanning carriage 38.

Figure 11:
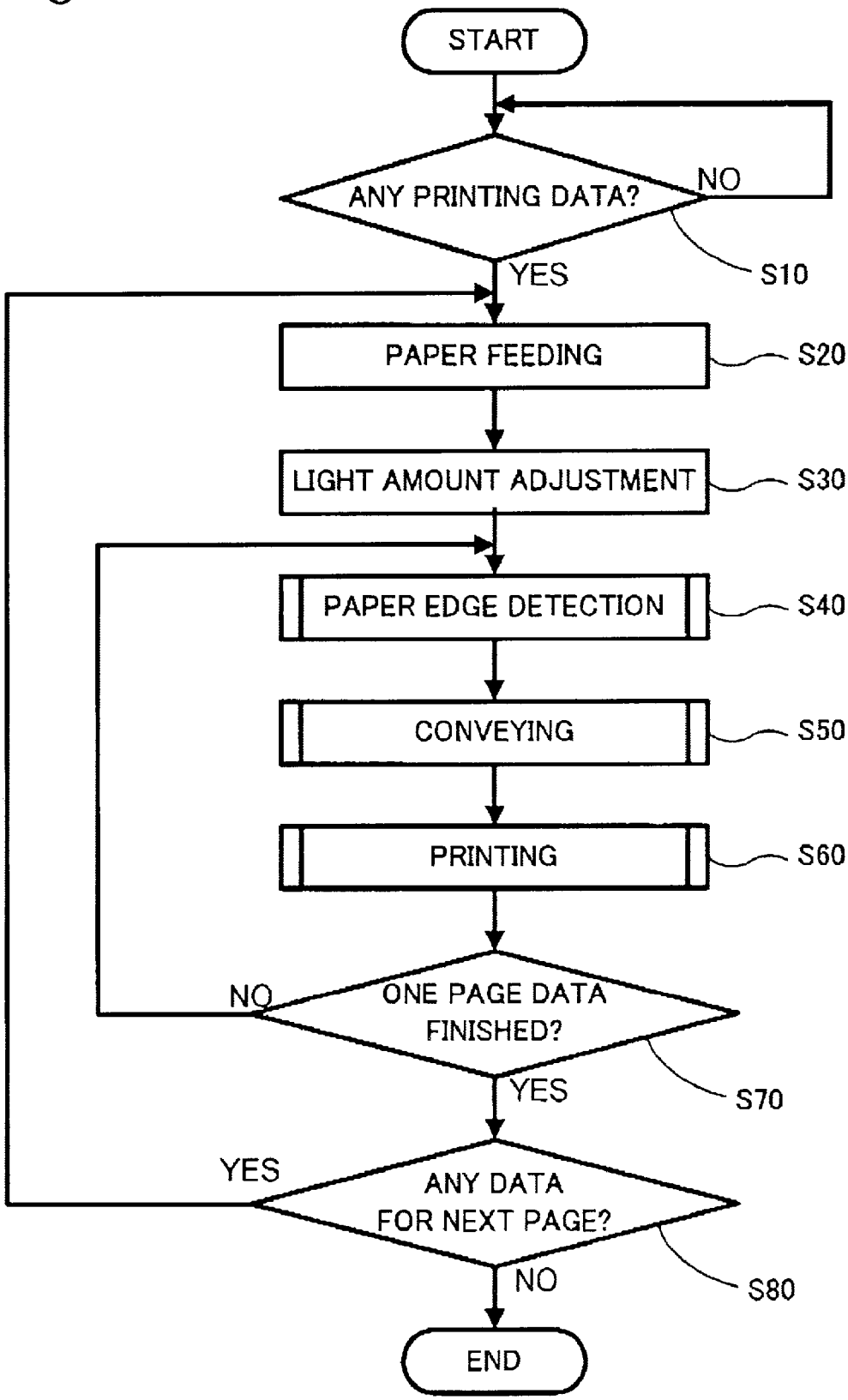
FIG. 11 is a flowchart of an image recording operation of the combined device of FIG. 1.
Figure 12:
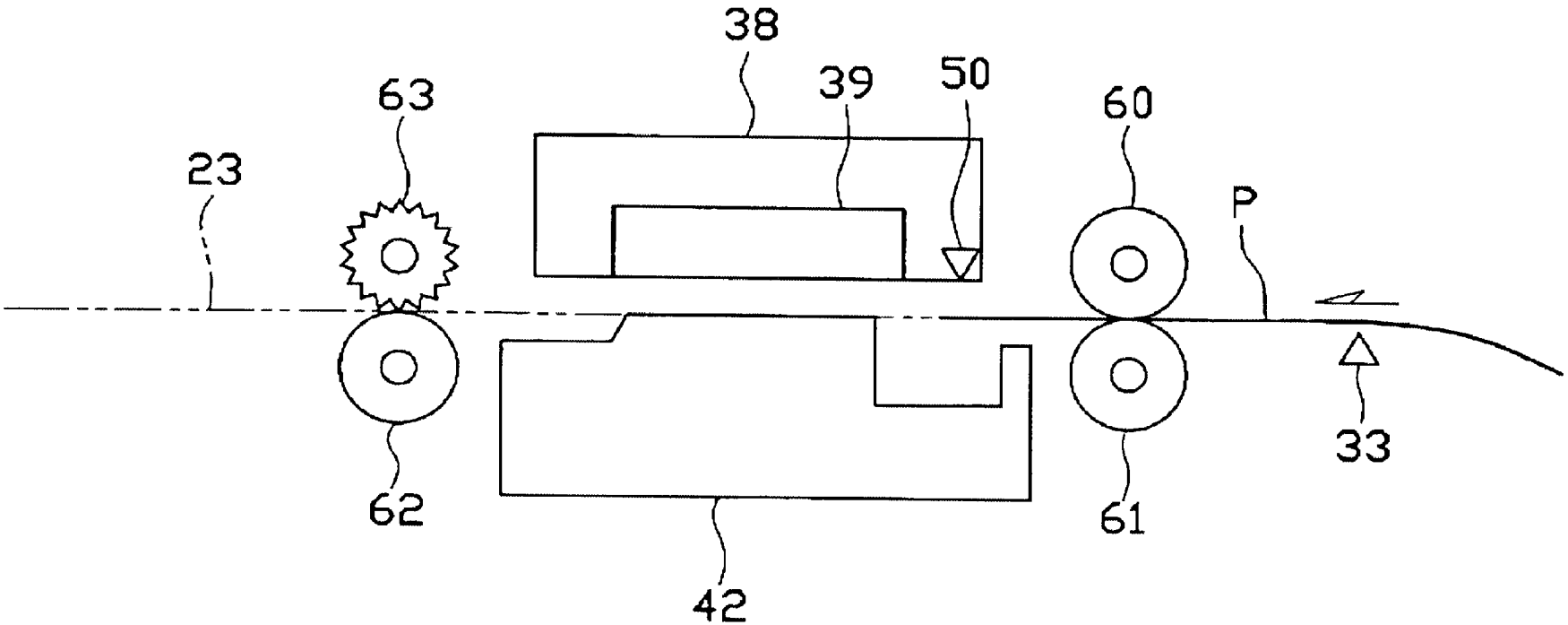
FIG. 12 is a schematic diagram showing a conveying state of a recording paper according to an embodiment of the present invention.

As shown in the flowchart of FIG. 11, when printing data is forwarded to the control section 64 from a computer or a small-sized memory card (S10), the printer section 2 of the combined device 1 starts feeding a recording paper P stored in the paper feed tray 20 (S20). That is, the LF motor 71 is driven, and the drive movement thereof is transmitted to the various components, e R., the paper feed roller 25, the conveying roller 60, and the paper ejection roller 62. As a result, the recording paper P is forwarded from the paper feed tray 20 to the conveying path 23. As shown in FIG. 12, the recording paper P is conveyed while being flipped over as if making a V-turn upward along the conveying path 23, and the front edge of the recording paper P is detected by the registration sensor 33. Thereafter, the rotation amount input to the conveying roller 60 or the like after the registration sensor 33 detects the recording paper P is grasped as the encoder amount of the rotary encoder 76. As shown in FIG. 11, the recording paper P is then forwarded until the proximal portion of the front edge of the recording paper P is disposed directly below the media sensor 50.

Figure 13:
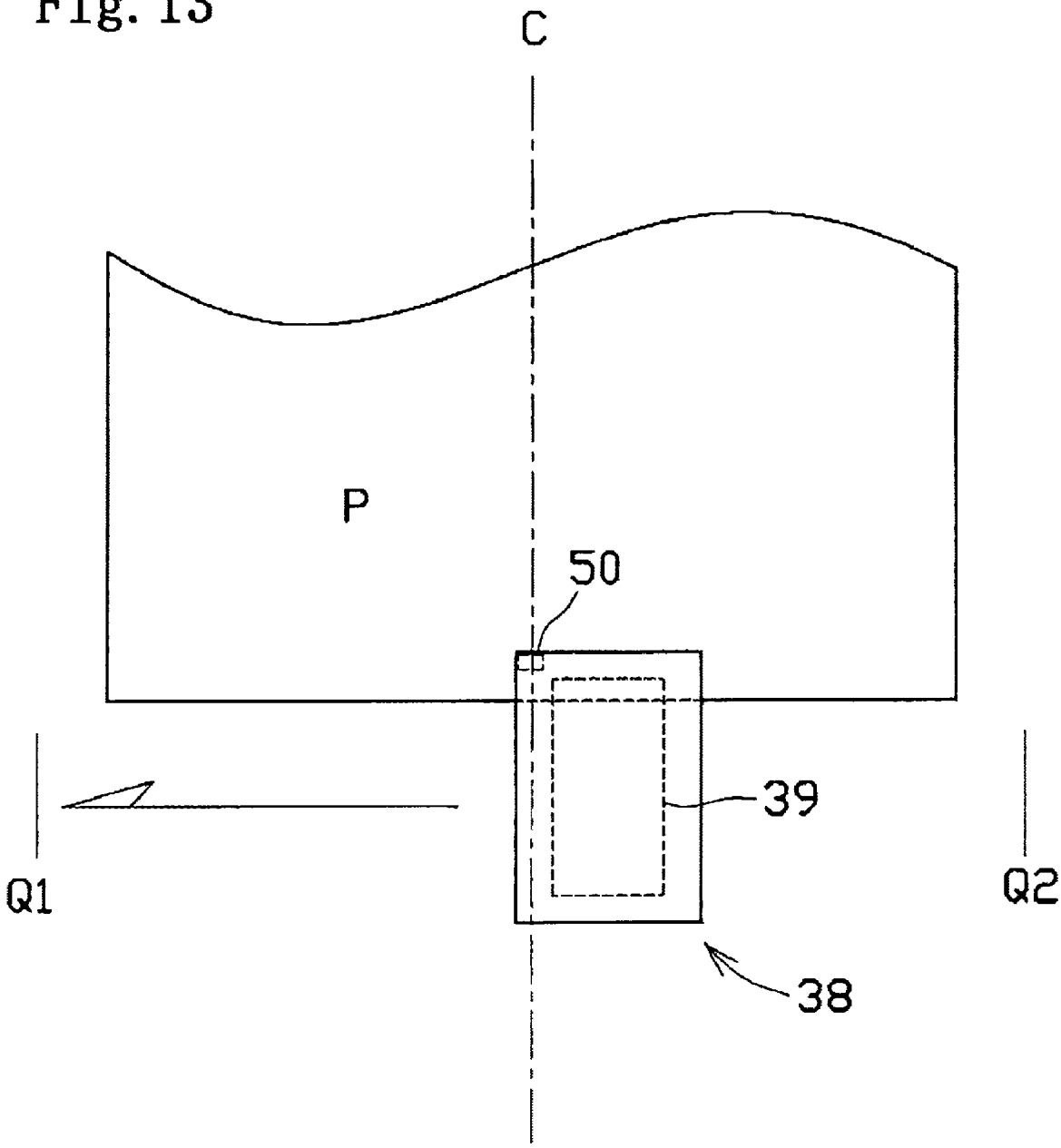
FIG. 13 is a plane view showing the position of the scanning carriage during light amount adjustment according to an embodiment of the present invention.

Thereafter, in the vicinity of the front edge of the recording paper P, the media, sensor 50 is adjusted in light amount (S30). As shown in FIG. 13, the scanning carriage 38 is moved so that the media sensor 50 is disposed at a center position C of the recording paper P. The center position C is on a reference line with so-called center registration of conveying the center portion of the recording paper P along the reference line. Here, the reference line is at substantially the center of the conveying path 23 in the width direction. If with a conveying method other than center registration, e.g., side registration, the center position C is determined based on the size of the recording paper P indicated by recording paper information (medium information) found in the printing data.

At the center position C, by providing a predetermined value to the light-emitting section 51 of the media sensor 50, the light-emitting section 51 accordingly emits light with a predetermined amount of light emission. The amount of light emission of this light-emitting section 51 may be adjusted, as is appropriate, depending on the paper type t of the recording paper P. For example, for a glossy paper through with a given process on the paper surface for photo printing, the amount of light reception of the light-receiving section 52 may be increased with the higher reflectivity than with a plain paper. In this sense, the amount of light reception vanes depending on the surface color of the recording paper P. Accordingly, the light-emitting section 51 may be adjusted in amount of light emission so as to keep the amount of light reception of the light-receiving section 52 constant with the recording paper P.

The media sensor 50 may be activated on at the center position C of FIG. 13 to make the light-emitting section 51 emit light with an initial amount of light emission, leading to the amount of light reception of the light-receiving section 52 The initial amount of light emission may be a small value, which is unlikely to lead to a target light reception amount with any paper type 1. With the initial light emission amount, the light reception amount of the light-receiving section 52 is smaller than the target value. Thereafter, the light emission amount of the light-emitting section 51 is increased based on a predetermined unit amount of light emission. When the light reception amount of the light-receiving section 52 reaches the target value, the light emission amount is determined as being an adjustment value.

Using the resulting adjustment value, the control section 64 defines the recording paper P by paper type t. The reflectivity against light emission from the light-emitting section 51 of the media sensor 50 of a plain paper is different from that of a glossy paper applied with a coating on the surface. The reflectivity of the glossy paper is higher than that of the plain paper. As such, the reflectivity varies depending on the paper type t of the recording paper P. Therefore, the reflectivity may be used as a basis to previously store adjustment values for any predetermined paper types t in the EEPROM 68. This enables to determine the paper type t through comparison with the adjustment values derived in the above-described manner. Thus determined paper types may be stored into the RAM 67 as paper type information (medium type information).

Thereafter, a paper width detection is performed in the vicinity of the front edge of the recording paper P (S40). For image recording to the recording paper P, generally, printing data comprising recording paper information is forwarded to the combined device 1 from a computer or the like. The recording paper information indicates the size of the recording paper P. Based on the recording paper information, the control section 64 may control the operation of the scanning carriage 38 and the recording head 39. Nevertheless, the recording paper P is not always correctly brought to the same position on the platen 42, and the lateral position of the recording paper P on the platen 42 generally is not the same, although the difference generally is small. At the time of image recording up to the edge of the recording paper P, e.g., so-called borderless printing, there is a need to accurately grasp the edge positions of the recording paper P, and applies control to the scanning carriage 38 and the recording head 39 may be applied based on the edge positions, such that the recording paper P may be recorded with images up to the ends with precision. This is because the recording paper P will be entirely recorded with images at its ends, and for the purpose of reducing the amount of ink to be discharged by the recording head 39 beyond the printing paper P.

Figure 14:
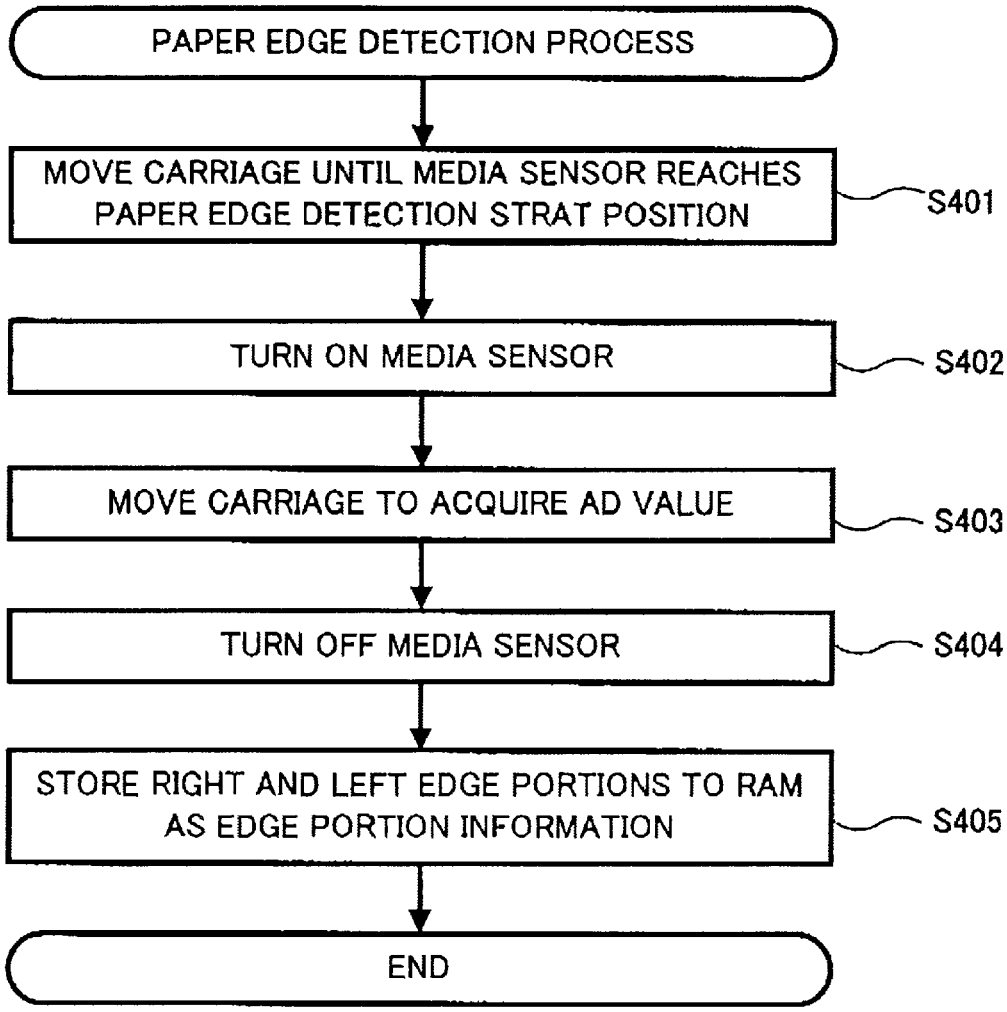
FIG. 14 is a flowchart of a paper edge detection process according to an embodiment of the present invention.
Figure 15:
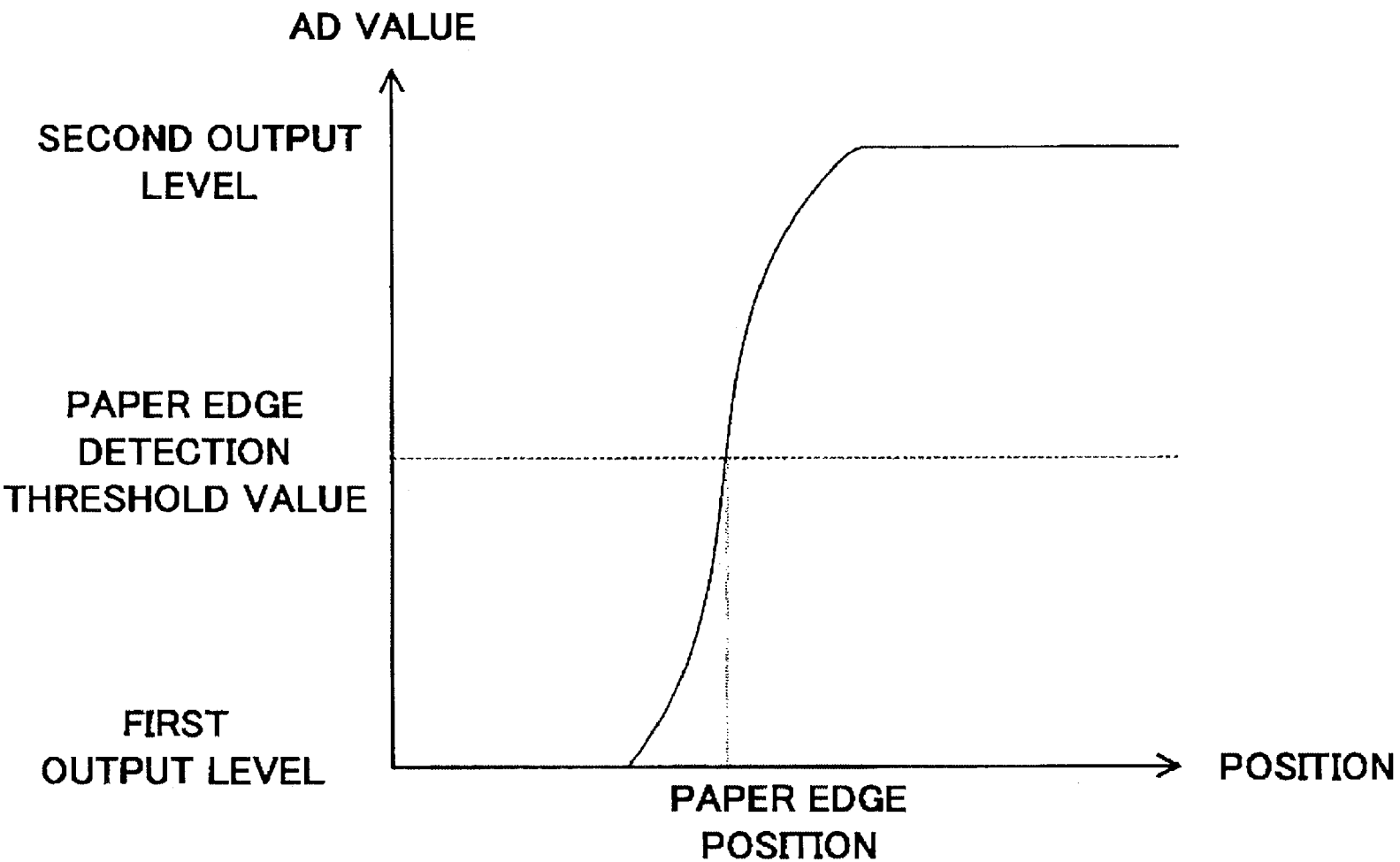
FIG. 15 is a graph showing the relationship between an Al) value derived by the media sensor and a paper edge position according to an embodiment of the present invention.

As shown in the flowchart of FIG. 14, to detect the right and left edges of the recording paper P, the scanning carriage 38 moves from the center position C of FIG. 13 to a paper edge detection start position Q1, which is located beyond the recording paper P (S401). It does not matter in which scanning direction the scanning carriage 38 moves, e.g., right or left, and in this example, the scanning carriage 38 moves to the left side of the drawing. To determine whether the position is within the recording paper P or not, a reference is made to the size of the recording paper P indicated by the recording paper information in the printing data received from the computer or the like. If the scanning carriage 38 is moved to the scanning end as far as it is allowed, it means that the position is out of the recording paper P with the possible maximum width for image recording.

The media sensor 50 is then activated (S402), and the scanning carriage 38 is moved in the direction opposite to the paper edge detection start position Q1, e.g., in the right toward a position Q2 of FIG. 13 (S403). The light-emitting section 51 of the media sensor 50 emits light of the adjusted light emission amount, and the resulting reflected light is received by the light-receiving section 52. The AD value being an output value of the light-receiving section 52 is stored in the RAM 67 of the control section 64 with a correlation established with the encoder amount of the linear encoder 77, which serves as the position information about the scanning carriage 38. The scanning carriage 38 is then moved to the position Q2 beyond the recording paper P, e.g., to the position opposite to the scanning start position, and the media sensor is deactivated (S404). During this operation, the AD value coming from the light-receiving section 52 is stored in the RAM 67.

Based on the AD value stored in the RAM 67, the right and left edges of the recording paper P are detected. In the vicinity of the left edge of the recording paper P of FIG. 13, for example, the AD value stored in the RAM 67 may be represented by the graph of FIG. 15. When there is no recording paper P at the corresponding position of the media sensor 50, e.g., when the light-receiving section 52 is receiving the reflected light from the platen 42, the AD value output from the light-receiving section 52 is at a first output level, which is a low level. The AD value increases in the vicinity of the left edge of the recording paper P, and when the position is within the recording paper P, the light-receiving section 52 receives the reflected light from the recording paper P, and the AD value output from the light-receiving section 52 is at a second output level, which is a high level. The position at which the detected AD value becomes a paper edge detection threshold value that has been set between the first and second output levels is determined as being the paper edge position. This paper edge detection threshold value is an intermediate value between the first and second output levels. In the vicinity of the right edge of the recording paper P, the AD value output from the light-receiving section 52 is changed from the second output level to the first output level. Therefore, any position showing the paper edge detection threshold value during this time is determined as being the paper edge position. As such, by detecting the right and left edge positions of the recording paper P in the vicinity of the front edge of the recording paper P, it is possible to accurately determine the width of the recording paper P prior to image recording. Thus, detected right and left edge positions of the recording paper P are stored into the RAM 67 as edge portion information (width information) (S405).

The recording paper P then is conveyed by a unity conveying distance L (S50). As a result, the tip edge of the recording paper P is brought to directly below the recording head 39. The recording head 39 discharges ink based on the printing data and the edge portion information while the scanning carriage 38 is being moved, and the recording paper P is recorded with images in the width direction (S60). Such an operation is repeated until the printing data for a page is complete (S70) so that the recording paper P is done with image recording.

Figure 16:
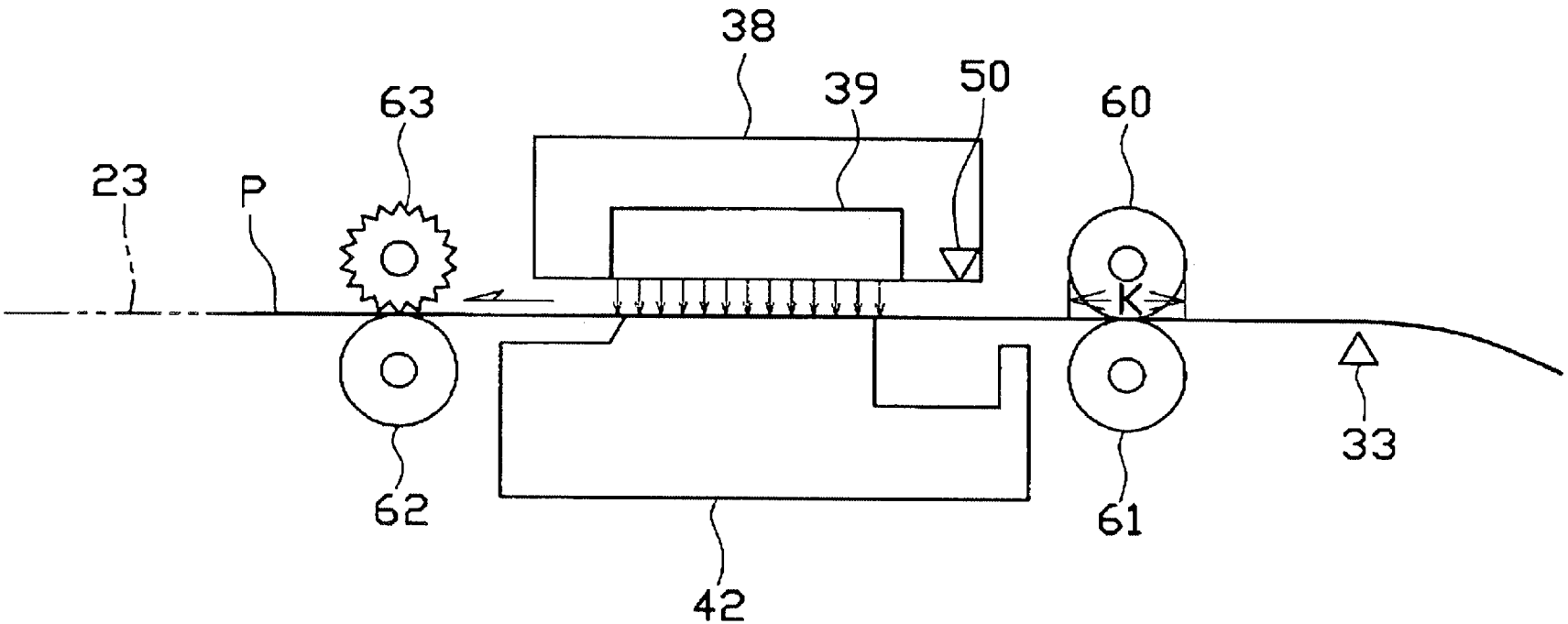
FIG. 16 is a schematic diagram showing the conveying state of the recording paper according to another embodiment of the present invention.

As shown in FIG. 16, the recording paper P nipped by the conveying roller 60 and the pressure roller 61 is conveyed in an intermittent manner on the platen 42 by the unit transfer amount L. During the time when the paper is conveyed by the unit shift amount L, the recording head 39 discharges ink while the scanning carriage 38 is being moved, so that image recording is started from the front edge of the recording paper P. As shown in FIG. 16, by repeating such an operation, the front edge of the recording paper P through with image recording is nipped by the paper ejection roller 62 and the spike roller 63. As such, the recording paper P is intermittently conveyed by the predetermined conveying distance L in the state that the front edge thereof is nipped by the paper ejection roller 62 and the spike roller 63, and the trailing edge thereof is nipped by the conveying roller 60 and the pressure roller 61, and is similarly subjected to image recording by the recording head 39.

Figure 17A:
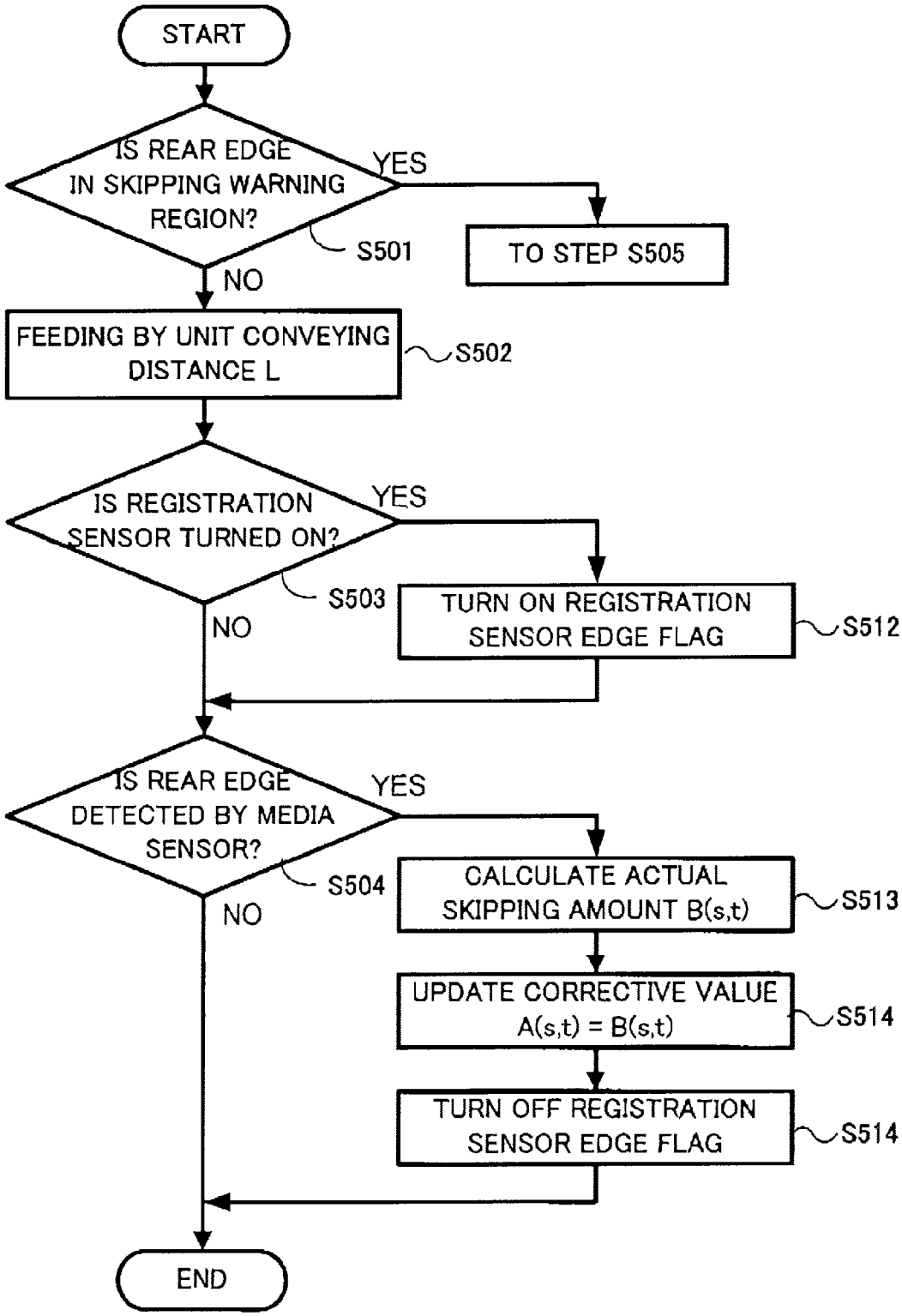
FIGS. 17A and 17B are flowcharts of a conveying process according to an embodiment of the present invention.
Figure 17B:
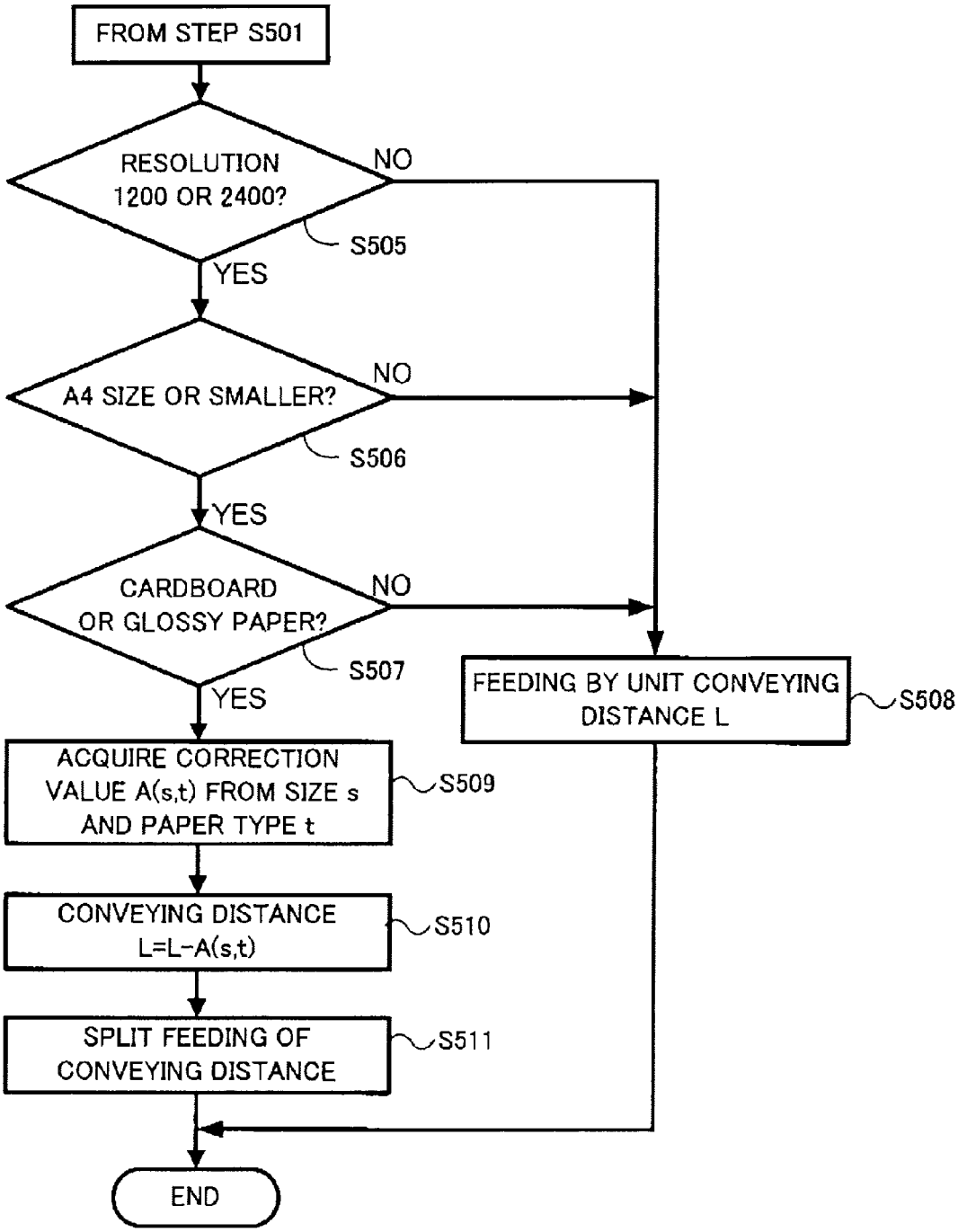

FIGS. 17A and 17B are flowcharts of a conveying process, however, the trailing edge of the recording paper P is not yet in a skip warning region K in the state of FIG. 16. Here, the skip warning region K denotes a region in which the recording paper P is likely to suffer from skipping. More specifically, the skip warning region K is a predetermined area including the portions of the conveying and pressure rollers 60 and 61 nipping the recording paper P on the upstream from the recording head 39, and the trailing edge of the paper passes through the nipping portion if the paper is conveyed by one more predetermined conveying distance L. To see whether the trailing edge of the recording paper P enters in the skip warning region K, the distance covered by the conveying roller 60 to convey the recording paper P is calculated based on the encoder amount of the rotary encoder 76. Such calculation is made after the registration sensor 33 detects the trailing edge of the recording paper P, e.g., after the registration sensor 33 that had been activated is deactivated. As such, in the state of FIG. 16, the registration sensor 33 is still active so that the control section 64 determines that the trailing edge of the recording paper P is not in the skip warning region K (S501).

The LF motor 71 then is driven by the predetermined conveying distance L, and in response to the drive movement, the conveying roller 60 and the paper ejection roller 62 are rotated by the predetermined conveying distance L As a result, the recording paper P is conveyed by the predetermined conveying distance L (S502). As already described, the registration sensor 33 is still active (S503), and the media sensor 50 is not yet detecting the trailing edge of the recording paper P (S504). Therefore, the conveying process is ended as it is.

Figure 18:
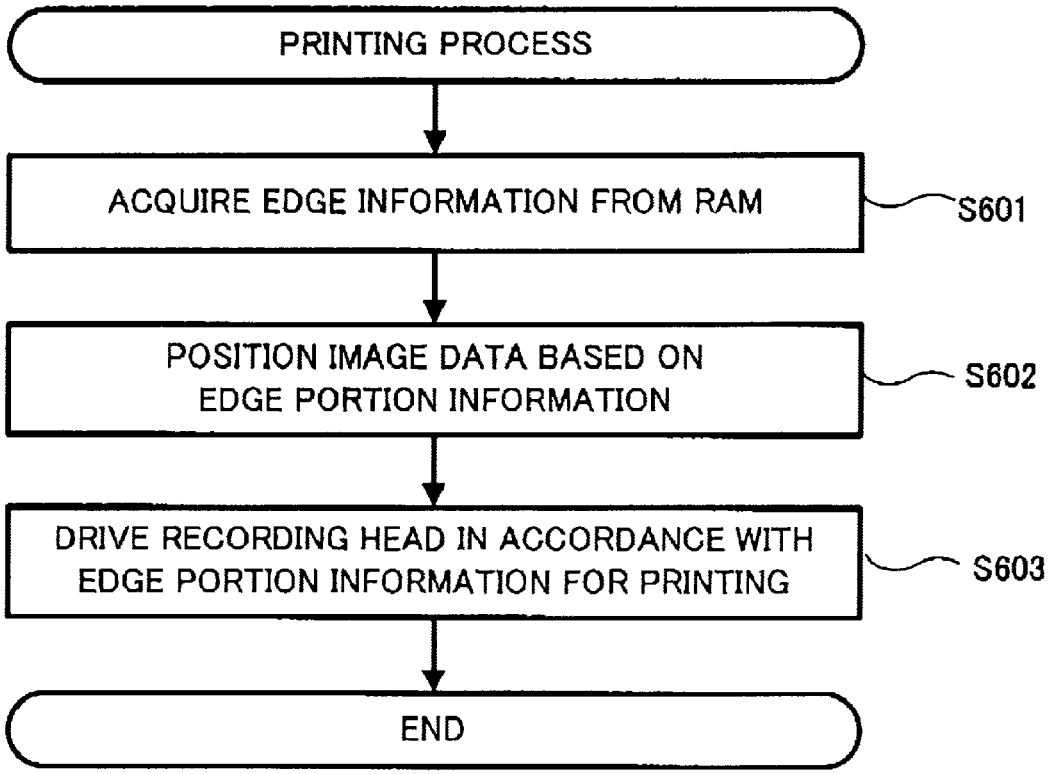
FIG. 18 is a flowchart of a printing process according to an embodiment of the present invention.

After the recording paper P is conveyed by the predetermined conveying distance L, the scanning carriage 38 is moved for image recording using the recording head 39. As shown in FIG. 18, the edge portion information of the recording paper P stored in the RAM 57 is read (8601), and the recording paper P is positioned using the printing data, Le., based on the right and left edge positions found in the edge portion information (8602). The recording head 39 the discharges ink at a predetermined timing for image recording (8603). For printing, the recording head 39 may make two-way trips in the reciprocating direction of the scanning carriage 38, or make one-way trips. Image data positioning may be made based on the right and left edge positions of the recording paper P stored in the RAM 67, deleting any image data beyond the right and left edges, or centering to match the center position of the recording paper P and the center position of image data Gn, or the like.

After the recording head 39 is done with image recording for a line feed pitch, the paper is repeatedly conveyed by the predetermined conveying distance L (850), and printed by a line feed pitch (860) until the printing data is done for the page.

Figure 19:
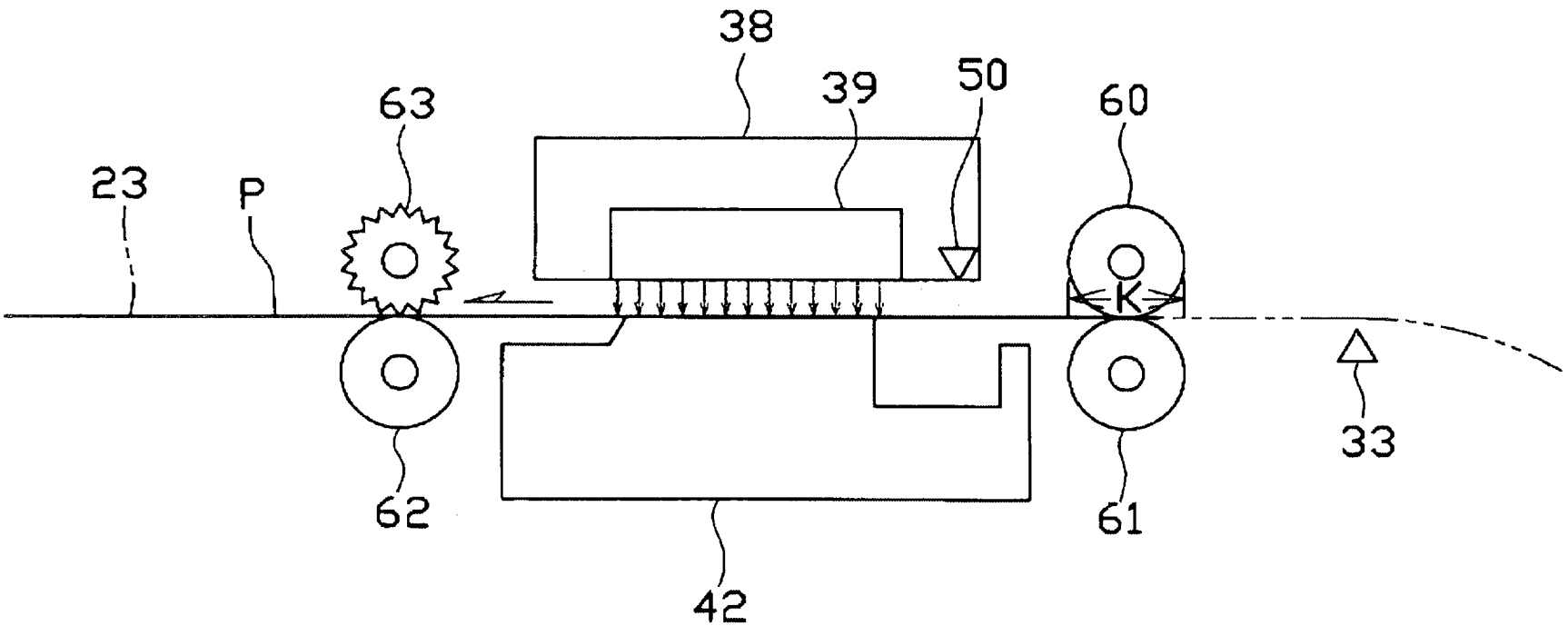
FIG. 19 is a schematic diagram showing the conveying state of the recording paper according to yet another embodiment of the present invention.

The paper edge detection (830) may be made for every predetermined conveying distance L, for every predetermined conveying distance larger than the predetermined conveying distance L, or only in the vicinity of the font edge of the recording paper P. In all of these cases, a sheet of recording paper P may be subjected to the paper edge detection for a plurality number of times. If so, even if the recording paper P is not correctly positioned, the right and left edge positions are to be detected depending on how the paper is not correctly positioned. This enables correct image recording to the right and left edge positions of the recording paper P After the recording paper P is conveyed to a further degree, as shown in FIG. 19, the trailing edge of the recording paper P passes over the detection position of the registration sensor 33 so that the registration sensor 33 is deactivated. In response to the sensor signal coming from the registration sensor 33, the control section 64 is able to detect the trailing edge of the recording paper P. The control section 64 then determines whether the trailing edge of the recording paper P enters the skip warning region K through comparison between two distances, Le., a distance of conveying the recording paper P after the registration sensor 33 is deactivated, and a distance from the sensor position of the registration sensor 33 to the upstream end position of the skip warning region K.

As shown in FIG. 19, when the trailing edge of the recording paper P enters the skip warning region K (8501), the control section 64 makes a plurality of decisions, e.g., whether the image recording is made with a predetermined resolution (8505), whether the recording paper P is less than or equal to a predetermined (8506), or whether the recording paper P is of a predetermined paper type (8507), or a combination thereof. The predetermined resolution may be set to 1200 dpi or 2400 dpi. The reason of making such a resolution determination is that, if the recording paper P suffers from skipping, the degradation of the recorded image is recognized by the naked eyes with the resolution of 1200 dpi or higher, but it is difficult to find degradation of the recorded image by the naked eyes with a resolution of 300 dpi or 400 dpi, because skipping does not significantly affect the image quality when the resolution is 300 dpi or 400 dpi. The lower resolution thus eases the control application by the control section 64, thereby leading to an increase in the image recording speed. The resolution generally is included in the printing data, and the control section 64 may make a determination based on the resolution found in the printing data.

In this embodiment, the predetermined size is A4. The reason for this size selection for the recording paper P is that, empirically, the larger the size of recording paper P, e.g., wider, the less likely it is that skipping occurs. The pressure roller 61 paired with the conveying roller 60 may be provided at a plurality of regular intervals in the axial direction of the conveying roller 60. With this configuration, the larger the size of the recording paper P, the more rollers 61 will be employed for nipping the recording paper P. Thus, the timing for each of the pressure rollers 61 releasing the nip force may be slightly on, and a skipping may be less likely to occur. Accordingly, the recording paper P may not be subjected to much. For the recording paper P of a size not to subjected to much skipping, whether or not skipping occurs thereto, the normal image recording operation will ease the control application by the control section 64. Accordingly, the image recording speed is increased for the recording paper P of the size larger than a predetermined size. The recording paper P may be defined by size based on the edge portion information stored in the RAM 67 in the above-described paper edge detection (840). The A4 size exemplified in this embodiment merely an example, and the size may be larger or smaller than A4 size.

In this embodiment, the predetermined paper size is cardboard or glossy paper. The paper type denotes the type of the paper, e.g., plain paper, cardboard, or glossy paper for photo printing. Every paper type has its own thickness and surface smoothness for a recording paper P, and for example, a thick recording paper P readily causes skipping, and if skipping occurs, the resulting skipping amount will large. On the other hand, a thin recording paper P, such as plain paper, does not cause much skipping phenomenon, and if skipping occurs, the resulting skipping amount will be small. Therefore, for a paper type that does not cause much skipping, such as plain paper, even if skipping occurs, whether or not skipping occurs thereto, the normal image recording operation will ease the control application by the control section 64. Accordingly, the image recording speed is increased for the plain paper. The recording paper P can be defined by paper type based on the paper type information stored in the RAM 67 in the above-described light amount adjustment (S30). The cardboard and glossy paper exemplified in this embodiment merely are examples, and any other paper types may be employed.

In the present embodiment, a setting is made to three requirements of resolution, size of the recording paper P, and paper type. The number of requirements is not restrictive to three.

When the resolution is not 1200 dpi or 2400 dpi (S505), when the size of the recording paper P is not A4 or smaller ($506), and when the paper type is not cardboard or glossy paper (S507), similarly to the above, the recording paper P is conveyed by the predetermined conveying distance L (S508). Therefore, whether the trailing edge of the recording paper P is in the skipping %Yaring region K or not, similarly to the above, paper conveying and image recording are performed.

On the other hand, when the resolution is 1200 dpi or 2400 dpi (S505), when the size of the recording paper P is A4 or smaller (S506), and when the paper type is cardboard or glossy paper (S507), the predetermined conveying distance L is first corrected (S509, S510), and split conveying is performed (S511).

The control section 64 refers to the correction value table T so that a correction value A(s,t) is determined (S509). As shown in FIG. 10, the correction value table T is set in relation to both the size s and the paper type t of the recording paper P, and stored in the EEPROM 68. Therefore, the control section 64 acquires, from the correction value table T, the correction value A(s,t) thus acquired for the size s and the paper type t of the recording paper P. When the recording paper P is a glossy paper of the 2L size, for example, the correction value A(s,t) is a7. The corrected predetermined conveying distance L is calculated by subtracting the correction value a7 from the predetermined conveying distance L (S510). The resulting corrected predetermined conveying distance L is used as a basis for split conveying (S511).

Instead of conveying the recording paper P all at once by the predetermined conveying distance L, the recording paper P may be conveyed intermittently by a small feed amount M, which is a fraction of the predetermined conveying distance.

Skipping occurs during this split feeding when the trailing edge of the recording paper P passes the nipping portion between the conveying roller 60 and the pressure roller 61. For the purpose of canceling out the skipping amount, the correction value a7 is subtracted from the predetermined conveying distance L.

Assuming that the encoder amount of the LF motor 71 equivalent to the predetermined conveying distance L is 138-encoder, and the correction value is 18-encoder, the predetermined conveying distance L after correction will be 120-encoder. If with the small feed amount M of 6-encoder, the predetermined conveying distance L after correction will be split into 20. Accordingly, the control section 64 drives the LF motor 71 in an intermittent manner, e g,. 20 times for every 6-encoder amount. As a result, the recording paper P is conveyed for a line feed pitch over 20 times. Thus, the speed of feeding the recording paper P in the conveying direction so that the possible skipping amount also is reduced for the recording paper P.

When the conveying path 23 is of so-called a U-turn path, which guides the recording paper P to the nipped portion between the conveying and pressure rollers 60 and 61 while making the paper turn around in the opposite direction, the recording paper P will be conveyed by the conveying and pressure rollers 60 and 61 as if lifting the paper upward. Therefore, the force of nipping the recording paper P by the conveying and pressure rollers 60 and 61 needs to be increased. With this being the case, the push-out force at the time of releasing the nipping also will be increased, thereby causing the recording paper P to skip. Therefore, the split conveying described above may be employed.

For the split feeding, there is no specific need to make the small feed amount M constant. However, by setting the constant amount as a result of n-splitting the predetermined conveying distance L as the small feed amounts M, the control application by the control section 64 is simplified. Although the splitting number n for splitting the predetermined conveying distance L may be any arbitrary value, if the splitting number n is too large, the conveying speed is resultantly reduced, and the accuracy for the split feeding becomes difficult to maintain 8 and 20 keep. In this sense, an exemplary range for the splitting number is from 8 to 20.

After the split feeding over 20 times, similar to the above, image recording is made for a line feed pitch (S60). During this time, the trailing edge of the recording paper P passes through the nipped portion between the conveying and pressure rollers 60 and 61, and skipping occurs. Nevertheless, the resulting skipping amount is cancelled out by the correction value a7 so that the resulting recorded image does not suffer from non-uniformity or print dropout.

Figure 20:
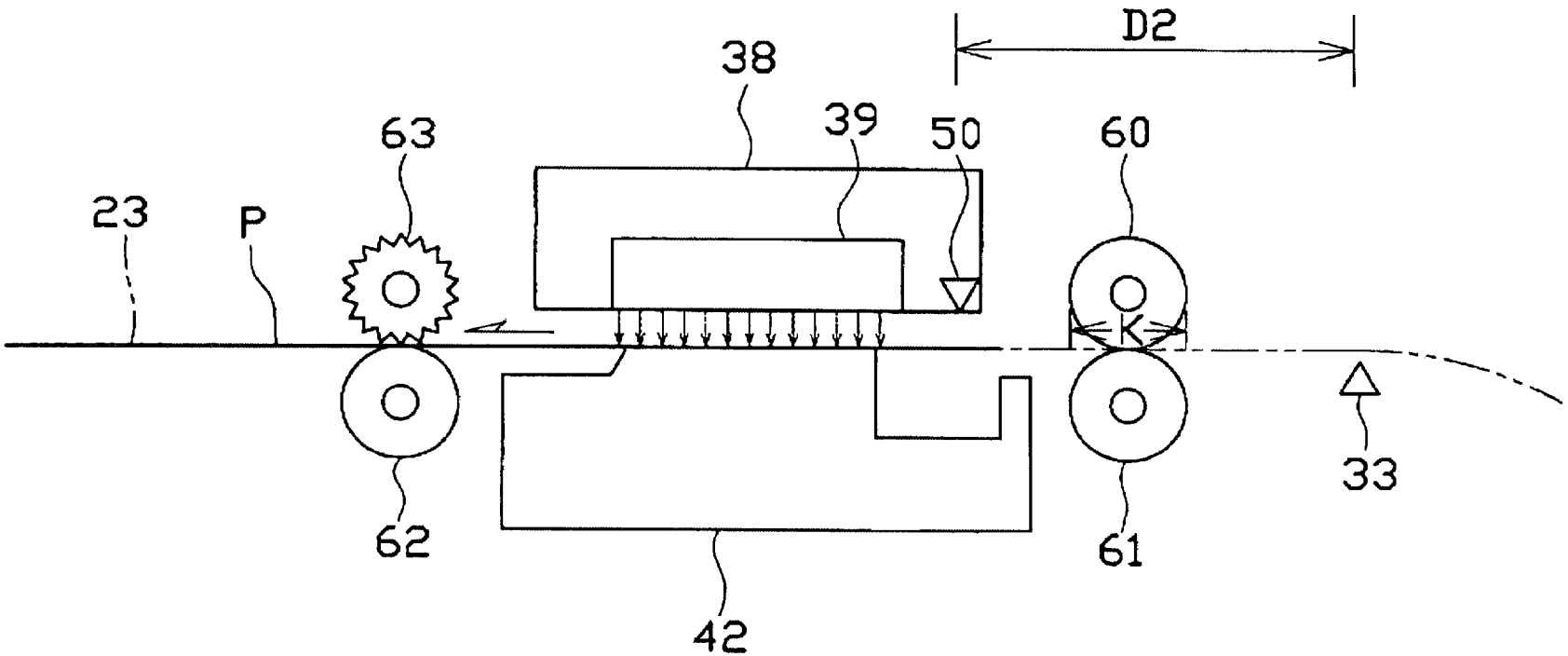
FIG. 20 is a schematic diagram showing the conveying state of the recording paper according to still yet another embodiment of the present invention.

Thereafter, the recording paper P having been passed, at its trailing edge, the nipped portion between the conveying and pressure rollers 60 and 61 is nipped by the paper-ejection and spike rollers 62 and 63 so that the paper is intermittently conveyed by the predetermined conveying distance L. In a similar manner to the above, the recording head 39 performs image recording. As shown in FIG. 20, after the trailing edge of the recording paper P moves out of the skipping warning region K, the trailing edge reaches in the vicinity of the detection position for the media sensor 50.

As shown in FIGS. 17A and 17B, after the trailing edge of the recording paper P is offset from the skipping warning region K (S501), the recording paper P is conveyed again by the predetermined conveying distance L (S502). Here, because the recording paper already passed the detection position for the registration sensor 33, the registration sensor 33 is deactivated (S503). The control section 64 triggers a trailing edge flag of the registration sensor (S512) for storage into the EEPROM 68 (S503). As shown in FIG. 20, when the proximal portion of the trailing edge of the recording paper P is beneath the media sensor 50, the trailing edge of the recording paper P is detected (S504). The determination factors whether the proximal portion of the trailing edge of the recording paper P is beneath the media sensor 50 or not are the conveying distance of the conveying and paper-ejection rollers 60 and 62 after the registration sensor 33 is deactivated, and the distance of the conveying path from the registration sensor 33 to the media sensor 50. When the trailing edge of the recording paper P is not located beneath the media sensor 50, a rear-edge detection operation may be skipped so that the operation speed is increased for image recording of the combined device 1.

Figure 21:
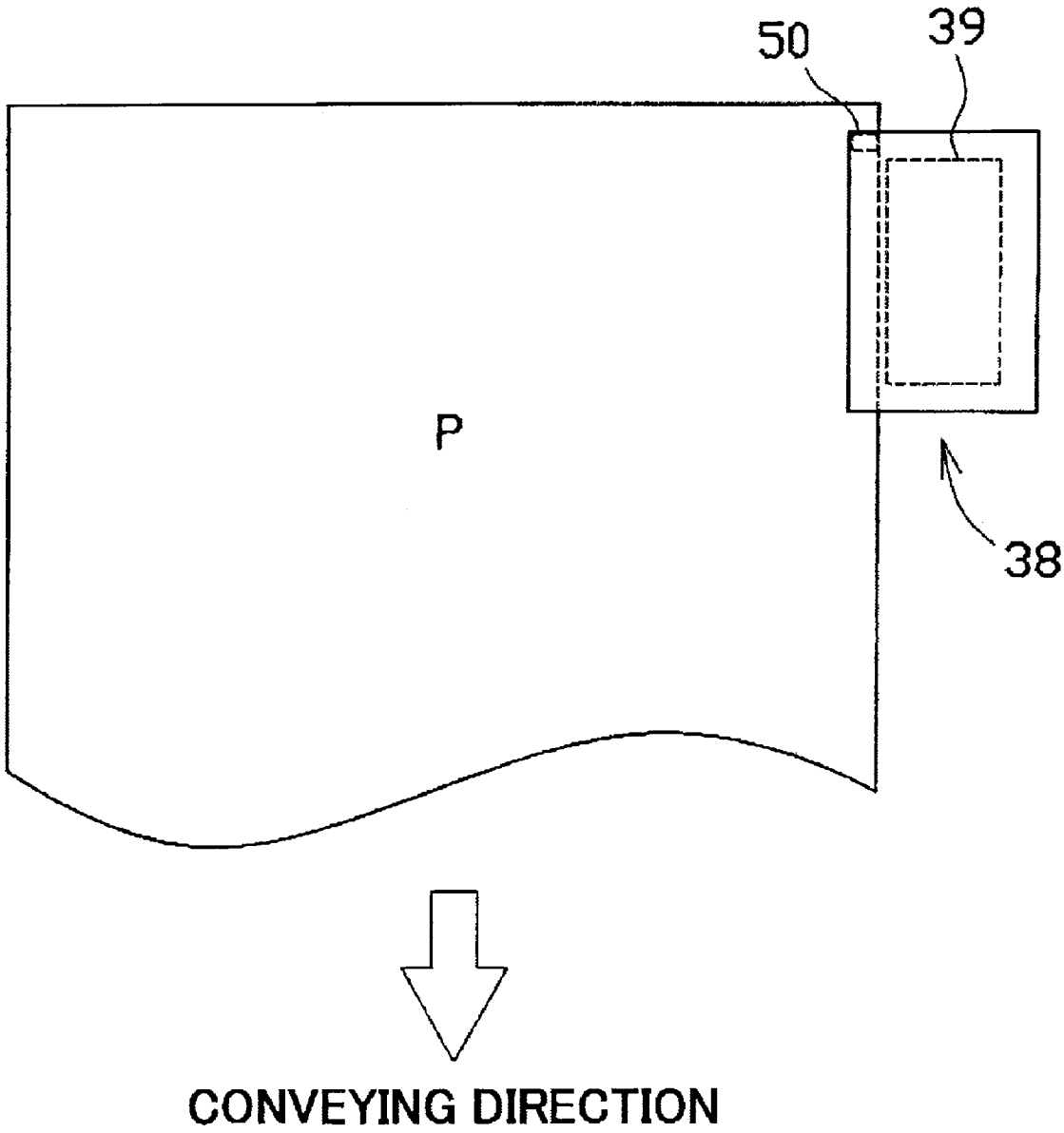
FIG. 21 is a plane view showing a standby position of the scanning carriage during paper trailing edge detection according to an embodiment of the present invention.
Figure 22:
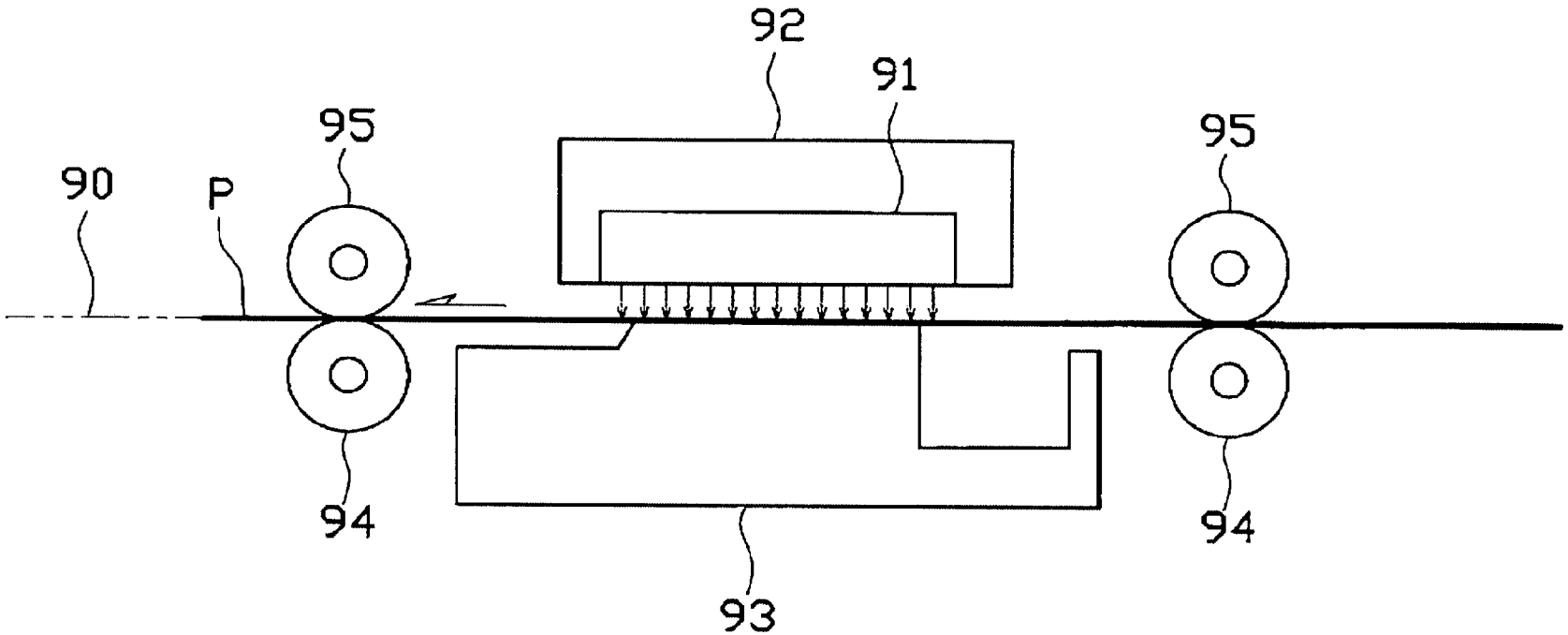
FIG. 22 is a schematic diagram showing the configuration of a known image recording device.
Figure 23:
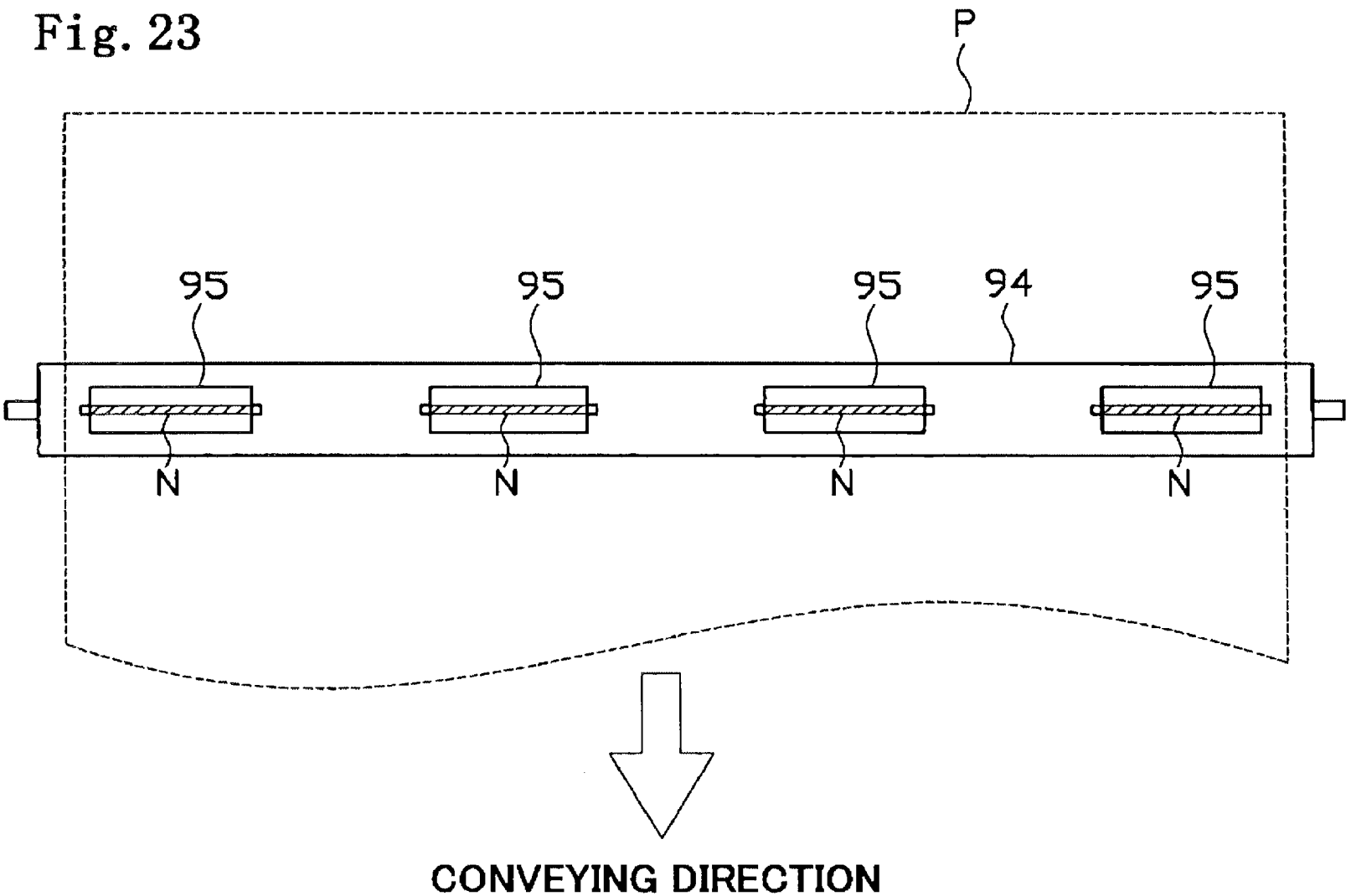
FIG. 23 is a plane view showing the state of the recording paper nipped by a conveying roller and a pressure roller of the known image recording device of FIG. 22.

As shown in FIG. 21, the scanning carriage 38 through with image recording for every line feed pitch is brought to the standby position. At this standby position, the recording head 39 comes out of the range of the recording paper P, e.g., further right than the right edge of the recording paper P in FIG. 21, and the media sensor 50 comes within the range of the recording paper, e.g., left from the right edge of the recording paper P in FIG. 21. At this standby position, the media sensor 50 is turned on. This standby position is determined by the edge portion information of the recording paper P, which is already detected. This allows positioning the recording head 39 out of the range of the recording paper P, and the media sensor 50 within the range of recording paper P.

While the scanning carriage 38 being placed at the standby position, the conveying and paper-ejection rollers 60 and 62 are driven to convey the recording paper P by the predetermined conveying distance L. The recording head 39 is put on standby out of the range of the recording paper P. Therefore, even if the recording paper P is conveyed in this state, the recording surface of the recording paper P does not touch the recording head 39.

On the other hand, by putting the media sensor 50 on standby within the range of the recording paper P, the trailing edge of the recording paper P may be detected at the time of paper conveying by the predetermined conveying distance L. The method of detecting the trailing edge of the recording paper P may be similar to the method of detecting the right and left edges of the recording paper P. That is, the recording paper P is conveyed with the media sensor 50 being activated, and during this time, the light is irradiated from the light-emitting section 51 of the media sensor 50, and the reflected light is received by the light-receiving section 52. The AD value being an output value of the light-receiving section 52 is stored in the RAM 67 of the control section 64 with a correlation with the encoder amount of the rotary encoder 76 of the conveying roller 60. Thereafter, based on the AD value stored in the RAM 67, the trailing edge of the recording paper P is detected from the paper-edge detection threshold value. The detected trailing edge position is stored in the RAM 67 as the edge portion information.

Thereafter, the control section 64 derives an actual skipping amount B(s,t) observed on the recording paper P (S513). In the time between after the registration sensor 33 detects the trailing edge of the recording paper P, e.g., after the registration sensor 33 is deactivated, but before the media sensor 50 detects the trailing edge of the recording paper P, if no skipping is occurring to the recording paper P, as shown in FIG. 20, a conveying distance D1 covered by the conveying and paper-ejection rollers 60 and 62 to convey the recording paper P is equal to a distance D2 of the conveying path 23 from the detection position of the registration sensor 33 to the detection position of the media sensor 50.

If the recording paper P is suffering from skipping, the conveying distance D1 covered by the conveying and paper-ejection rollers 60 and 62 to convey the recording paper P is shortened by the skipping amount B(s,t) caused by the skipping. Therefore, the control section 64 uses the encoder amount of the rotary encoder 76 as a basis to determine the rotation amount provided to the conveying and paper-ejection rollers 60 and 62 in the time between after the registration sensor 33 is deactivated but before the media sensor 50 detects the trailing edge. The encoder amount then is used to calculate the conveying distance D1, and a difference between the conveying distance D1 and the distance D2 is determined to be the actual skipping amount B(s,t) as a result of the skipping of the recording paper P. The actual skipping amount B(s,t) is stored in the RAM 67 with a correlation with the size s and the paper type t of the recording paper P.

Thereafter, the control section 64 uses the actual skipping amount B(s,t) as a basis to update, in the correction value table T, the correction value A(s,t) corresponding to the size s and the paper type t of the recording paper P (S514). Assuming that the size s of the recording paper P is 2L, and the paper type t thereof is glossy paper, the value of a7 is updated. This update may be made by replacing the skipping amount B(s,t) with the correction value a7. Alternatively, an average value may be calculated from the skipping amounts B(s,t) that will be derived for the next other pages, and the resulting average value may be determined to be the correction value. The trailing edge flag for the registration sensor then is deactivated for storage into the EEPROM 68 (S515).

As shown in FIG. 10, when the image for recording is spread over a plurality of pages, and after printing data is done for a page (S70), if printing data for the next page is being transmitted (S80), the recording paper P for the next page is fed from the paper-feed tray 20 to the conveying path 23 at a predetermined timing (S20). For the recording paper P for the next page, similarly to the above, the light amount adjustment is performed (S30), and after the paper edge detection (S40), the paper is conveyed by the predetermined conveying distance L of a line feed pitch (S50), and image recording is performed (S60). When the trailing edge of the recording paper P enters into the skipping warning region K, similarly to the above, a determination is made about the resolution, size, and the paper type When the determination is made that the recording paper P is meeting the requirements, the predetermined conveying distance L is corrected before split conveying. If the recording paper P is currently in the process of image recording, the predetermined conveying distance L for the recording paper P is corrected using the corrected correction value A(s,t). This is because the correction value table T for the use of correction has been updated based on the skipping amount B(s,t) actually occurred to the previous recording paper P.

The correction value table T is set with a correction value A(s,t) with a correlation with the size s and the paper type t of the recording paper P. However, the same size s and paper type t of the recording paper P do not always result in the same skipping amount B(s,t) for every combined device 1, and the skipping amount may vary even for a single piece of combined device 1. This is because the actual skipping amount B(s,t) observed on the recording paper P is affected by the conditions of the roller surfaces of the conveying and pressure rollers 60 and 61, the conditions of elastic members for biasing the pressure roller 61, e.g., spring, and various requirements of the recording paper, e.g., hygroscopicity. Therefore, as described above, by updating the preset correction value A(s,t) in the correction value table T based on the actually-detected skipping amount B(s,t), for the recording paper P for image recording after the next page, the predetermined conveying distance L can be corrected using the correction value approximate to the actual skipping amount. This allows making a skipping amount correction in consideration of the above-described various elements affecting the skipping of the recording paper P.

As such, according to the combined device 1 of the present embodiment, when the recording paper P is located in the skipping warning region K, the correction value A(s,t) in the correction value table T is used as a basis to correct the predetermined conveying distance L for paper conveying so that the actual skipping amount B(s,t) as a result of skipping having occurred to the recording paper P is cancelled out by the correction value A(s,t). As such, any skipping having occurred to the recording paper P may be cancelled out, and in the resulting recorded image, the portion in the vicinity of the trailing edge of the recording paper P may be prevented from image degradation.

Based on the conveying distance D1 covered by the conveying and paper-ejection rollers 60 and 62 to convey the recording paper P in the time between after the registration sensor 33 detects the trailing edge of the recording paper P but before the media sensor 50 detects the trailing edge of the recording paper P, and based on the distance D2 of the conveying path 23 from the registration sensor 33 to the media sensor 50, the actual skipping amount B(s,t) observed on the recording paper P is calculated. Based on thus calculated skipping amount B(s,t), the correction value A(s,t) in the correction value table T is sequentially updated so that any skipping having occurred to the recording paper P for the next image recording may be cancelled out with precision. As such, the portion in the vicinity of the trailing edge of the recording paper P can be prevented from image degradation.

In the present embodiment, the size s and the paper type t of the recording paper P are determined based on the edge portion information and the paper type information, which are stored in the RAM 67 in the light amount adjustment (S30) and the paper edge detection (S40). Alternatively, the size s and the paper type t in the recording paper, information found in the printing data provided by a computer may be used as a basis to select the correction value A(s,t) in the correction value table T. Still alternatively, the size of the recording paper P may be determined based on a sensor signal coming from a senor, which is provided to the paper-feed tray 20 or in the width direction of the conveying path 23 for detecting whether there is a recording paper P. With this being the case, it will be enough if the width of the recording paper P is at least determined if the size of the recording paper P is not determined.

While the invention has been described in connection with embodiments, it will be understood by those skilled in the art that other variations and modifications of the embodiments described above may be made without departing from the scope of the intention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. An image recording device, comprising:

a conveying mechanism disposed in a predetermined conveying path comprising a plurality of rollers for conveying a recording medium by a predetermined conveying distance while nipping the recording medium;

a recording unit for recording an image to the recording medium over the predetermined conveying distance;

an upstream-side trailing edge detector disposed on an upstream side of the plurality of rollers for detecting a trailing edge of the recording medium based on a sensor signal generated by a first sensor which senses a presence of the recording medium;

a downstream-side trailing edge detector disposed on a downstream side of the plurality of rollers for detecting the trailing edge of the recording medium based on a sensor signal generated by a second sensor which senses the presence of the recording medium;

a skip warning region determination unit for determining whether or not the trailing edge of the recording medium is located in a skip warning region, based on a distance between a current position where the recording medium is currently located and a reference position of the recording medium where the upstream-side trailing edge detector detected the trailing edge of the recording medium;

a storage unit for storing a correction value table for the skip warning region, the correction table comprising at least one predetermined correction value;

a correction unit for receiving the at least one predetermined correction value from the correction value table, the correction unit configured to correct the predetermined conveying distance by the at least one predetermined correction value only when the trailing edge of the recording medium is in the skip warning region;

an actual conveyed distance detecting unit for automatically detecting an actual conveyed distance of the recording medium between a conveyed position where the downstream-side trailing edge detector detects the trailing edge of the recording medium and the reference position;

a skipping distance calculation unit for automatically calculating the skipping distance occurred on the recording medium based on the detected actual conveyed distance; and an correction value adjusting unit for automatically adjusting the predetermined correction value in the correction value table based on the calculated skipping distance.

2. The image recording device according to claim 1, wherein when the trailing edge of the recording medium is located in the skip warning region, the conveying mechanism conveys the recording medium by a feed amount which is a fraction of the predetermined conveying distance.

3. The image recording device according to claim 1, wherein when the recording unit performs image recording with a resolution greater than or equal to a predetermined level the correction unit corrects the predetermined conveying distance.

4. The image recording device according to claim 1, wherein when the recording medium is less than or equal to a predetermined size, and the correction unit corrects the predetermined conveying distance.

5. The image recording device according to claim 1, wherein when the recording medium is of a predetermined medium type, and the correction unit corrects the predetermined conveying distance.

6. The image recording device according to claim 4, wherein the correction value table comprises correction values that are correlated with the recording medium for a plurality of predetermined medium types.

7. The image recording device according to claim 6, wherein the correction value table further comprises correction values that are correlated with the recording medium for a plurality of predetermined medium sizes.

8. The image recording device according to claim 4, wherein the correction value table further comprises correction values that are correlated with the recording medium for a plurality of predetermined medium sizes.

9. The image recording device according to claim 6, further comprising an information input port, wherein the correction unit selects the predetermined correction value from the correction value table based on recording medium information associated with at least one of the size of the recording medium and the medium type of the recording medium, wherein the medium information is received via the information input port.

10. The image recording device according to claim 4, wherein the correction unit determines the size of the recording medium based on a width of the recording medium and comprises a width detector that scans the recording medium in a width direction to detect a width of the recording medium.

11. The image recording device according to claim 4, wherein the correction unit determines the medium type of the recording medium based on medium type information provided by a medium type determination unit that exposes the recording medium to light, and determines the medium type of the recording medium based on an amount of reflected light from the recording medium.

12. The image recording device according to claim 1, wherein the sensor of the downstream-side trailing edge detector comprises a light-emitting section that exposes the recording medium to the light, and a light-receiving section that receives the reflected light from the recording medium.

13. The image recording device according to claim 12, wherein the downstream-side trailing edge detector detects the trailing edge of the recording medium by sensing whether a light reception amount of the second sensor is greater than or equal to a predetermined threshold value.

14. The image recording device according to claim 12, further comprising a scanning carriage, wherein the scanning carriage comprises the second sensor and scans in a direction orthogonal to a conveying direction of the recording medium.

15. The image recording device according to claim 14, wherein the correction unit determines the size of the recording medium based on a width of the recording medium and comprises a width detector that scans the recording medium in a width direction to detect a width of the recording medium, wherein the width detector detects the width of the recording medium based on the light reception amount of the second sensor provided to the downstream-side trailing edge detector.

16. The image recording device according to claim 14, wherein the second sensor is the light receiving section.

17. The image recording device according to claim 12, wherein the recording unit is provided with a recording head that performs image recording on the recording medium, and a scanning carriage comprising the recording head to scan in the direction orthogonal to the conveying direction of the recording medium, and the second sensor.

18. The image recording device according to claim 1, wherein the predetermined correction value equals a skipping distance observed on the recording medium.

* * * * *